US008233355B2

(12) United States Patent
Bizzell et al.

(10) Patent No.: US 8,233,355 B2
(45) Date of Patent: Jul. 31, 2012

(54) ALARM DEVICE

(75) Inventors: Daniel Lee Bizzell, Davidson, NC (US); Kevin J. Dahlquist, Charlotte, NC (US); Ian Kovacevich, Charlotte, NC (US); Carole Ruffin, Cleveland, OH (US)

(73) Assignee: Edison Nation, LLC, Charlotte, NC (US)

( * ) Notice: Subject to any disclaimer, the term of this patent is extended or adjusted under 35 U.S.C. 154(b) by 546 days.

(21) Appl. No.: 12/537,952

(22) Filed: Aug. 7, 2009

(65) Prior Publication Data

US 2010/0061196 A1 Mar. 11, 2010

Related U.S. Application Data

(60) Provisional application No. 61/087,595, filed on Aug. 8, 2008.

(51) Int. Cl.
*G04F 10/00* (2006.01)

(52) U.S. Cl. ..... 368/109; 368/250

(58) Field of Classification Search ..... 368/107–109, 368/244, 250, 72, 223, 262
See application file for complete search history.

(56) References Cited

U.S. PATENT DOCUMENTS

| | | | | |
|---|---|---|---|---|
| 4,218,875 | A * | 8/1980 | Rothman | 368/73 |
| 4,287,964 | A | 9/1981 | Sollenberger | |
| 4,444,513 | A * | 4/1984 | Proellochs et al. | 368/223 |
| 4,585,358 | A | 4/1986 | Shay | |
| 4,702,614 | A | 10/1987 | Copley et al. | |
| 4,941,137 | A * | 7/1990 | Kikuchi | 368/223 |
| 4,985,878 | A * | 1/1991 | Yamada et al. | 368/88 |
| 5,023,853 | A | 6/1991 | Kawata et al. | |
| 5,089,998 | A | 2/1992 | Rund | |
| 5,095,468 | A | 3/1992 | Sato | |
| 5,144,600 | A | 9/1992 | Cheng | |
| 5,262,763 | A * | 11/1993 | Okuyama et al. | 345/87 |
| 5,297,981 | A | 3/1994 | Maxim et al. | |
| 5,425,006 | A | 6/1995 | Ya | |
| 5,568,452 | A | 10/1996 | Kronenberg | |

(Continued)

FOREIGN PATENT DOCUMENTS

DE 29918533 U1 2/2000

OTHER PUBLICATIONS

Information Disclosure Statement (IDS) Letter Regarding Common Patent Application(s), Dated Jun. 3, 2010.

(Continued)

*Primary Examiner* — Sean Kayes
(74) *Attorney, Agent, or Firm* — Tillman Wright, PLLC; James D. Wright; Chad D. Tillman

(57) ABSTRACT

An alarm device includes a first portion housing an alarm component for producing an audible sound upon actuation in response to an alarm event and a second portion housing a vibration-inducing component for producing shaking movement in the device upon actuation in response to an alarm event. The first and second portions are pivotably engaged with one another to permit swiveling movement of one of either the first or second portion relative to the other portion. The first and second portions are pivotable between a first position, wherein opposing surfaces of each of the first and second portions are substantially fully aligned with one another, and a second position, wherein opposing surfaces of each of the first and second portions are substantially exposed.

20 Claims, 33 Drawing Sheets

U.S. PATENT DOCUMENTS

| | | | | |
|---|---|---|---|---|
| 5,892,350 | A | 4/1999 | Yoshikawa | |
| 6,236,621 | B1 | 5/2001 | Schettino | |
| 6,753,760 | B2 | 6/2004 | Schwartz | |
| 6,838,994 | B2 | 1/2005 | Gutta et al. | |
| 6,944,098 | B2 * | 9/2005 | Rochat et al. | 368/88 |
| 7,355,928 | B2 | 4/2008 | Nanda | |
| 7,751,284 | B2 | 7/2010 | Tang | |
| 2002/0080035 | A1 | 6/2002 | Youdenko | |
| 2003/0142591 | A1 | 7/2003 | Baweja et al. | |
| 2007/0008825 | A1 | 1/2007 | Tang | |

OTHER PUBLICATIONS

"Throw It! Alarm Clock", Lazybone, downloaded Mar. 14, 2007, 2 pages, http://www.lazyboneuk.com/store/pro739.html.

"Colour Changing Weather Forecaster changes colors", Gizmodiva.com, tagged Jan. 12, 2007, downloaded Mar. 14, 2007, 3 pages, http://www.gizmodiva.com/home_gadgets/colour_changing_weather_forecaster_changes. . . .

Information Disclosure Statement (IDS) Letter Regarding Common Patent Application(s), dated Nov. 6, 2009.

* cited by examiner

124

122

ALARM DEVICE

CROSS REFERENCE TO RELATED APPLICATIONS

The present application is a U.S. nonprovisional patent application of, and claims priority under 35 U.S.C. §119(e) to, U.S. provisional patent application Ser. No. 61/087,595, filed Aug. 8, 2008, which application is incorporated by reference herein.

Furthermore, the present application incorporates the following applications and application publications by reference herein:

(1) U.S. provisional patent application Ser. No. 60/696,547, filed Jul. 6, 2005, (2) U.S. provisional patent application Ser. No. 60/772,512, filed Feb. 13, 2006, and (3) U.S. non-provisional patent application Ser. No. 11/379,903, filed Apr. 24, 2006, and U.S. Patent Application Publication No. US 2007/0008825 A1, which is the publication of the '903 application.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The invention relates generally to clocks and alarm clocks. These devices are typically employed by a user to assist them in determining the current time. Also, alarm clocks are used to alert a person when a given pre-set alarm time is now the current time. This is commonly used to assist a person in waking up for work or an appointment. For example, if the time is currently 10:00 pm and the user wishes to awake at 7:00 am the next day, they use an alarm clock to alert them when 7:00 am the next morning arrives. The alarm clock is set to the desired alarm time, e.g. 7:00 am, the night before so the alarm timely goes off.

In the prior art, alarm clocks are very well known. These devices are either mechanical or electronic in nature. In the example of a mechanical alarm clock, a mechanical time keeping mechanism with gears and springs are employed to keep time. Winding the clock or electrical power maintains the time keeping mechanism moving to, in turn, keep the time accurate and current. In a mechanical alarm clock, a hammer and bell are typically actuated at the alarm event to wake the user by a loud bell ringing sound.

In the case of electronic clocks, time keeping and alarms are similarly carried out. However, the time keeping and alarm setting are electronic in nature rather than mechanical. For example, a solid state clock, powered by batteries or AC power, enables accurate time keeping and alarm event triggering because the exact times can be set with precision, such as to the minute. Typical electronic alarm clocks sound a buzzer or beeper at the time of the alarm event at time of the user's choosing.

Despite the foregoing attempts in the prior to alert a user of the an alarm event time, audible sound alarm are frequently inadequate for effectively alerting the user to the alarm event, particularly if they are using the alarm clock to wake them out of deep sleep where they may be apt to do whatever is necessary to silence the audible alarm. In summary, these known audible alarm clocks are much too easy to turn off. For example, a user can simply reach over to their alarm clock on their nightstand from the comfort of their bed and depress an alarm shut off button to fully silence the alarm without ever really waking up when they want. This increases the risk that the person might sleep completely through their alarm as this routine does not require them to fully awaken nor open their eyes much. Also, a user can repeatedly hit a "snooze" button on the alarm clock to delay the alarm for a certain amount of time, such as 10 minutes, which lead to bad habits of waking up later than you intended.

There has been a number of attempts in the prior art to address these problems with prior art alarm clocks. There are various prior art alarm clocks that also include some type of vibration mechanism that can be actuated with or without the audible alarm sound. For example, an alarm clock, that can fit in a users pocket, can be provided with a vibration mechanism that actuates at the alarm time without an audible alarm so that a user can be silently alerted to an alarm time. These alarm clocks can also be provided with structures that fit under a pillow, or the like, to silently alert the user when it is time to wake up. In general, these vibrating alarm clocks are intended to be in a fixed location to silently alert the user of an alarm time.

Even though these prior art alarm clocks vibrate, they are still very easy to turn off by the user because they stay fixed in a single location. As a result, they are very easy to locate and handle by the user which enables the user to easily turn them off in similar fashion to an alarm clock with a simple audible alarm.

Still further, there have been attempts in the prior art to provide an alarm clock that moves from one location to another to makes it difficult for the user to easily turn it off to prevent them from sleeping through their alarm. For example, such a clock can include wheels to cause the alarm clock to roll away, off of the user's nightstand for example, to a location remote therefrom. In this prior art device, the alarm clock remains still and in a fixed location when the audible alarm goes off. However, if the "snooze" button is depressed, the entire alarm clock will roll away off of the nightstand until it hits a barrier, such as a wall. When the end of the "snooze" period is over, the user will have to find the device and then turn off the alarm. When the user finds this prior art device, it is essentially still with the exception that the wheels may still be rotating. If the alarm is immediately shut off, the audible alarm is silenced and the alarm clock will not move any further. Since this device is still when the alarm sounds and picked up by a user, it is very easy to turn off.

The foregoing prior art suffers from many problems. For example, prior art alarm clocks are too easy to turn off because they are easy to locate. The addition of vibration is for use as a silent alarm not for making it more difficult to turn off the alarm by the user. Rolling alarm clocks are similarly inferior because the alarm clock device is easy to retrieve, locate and hold by the user making it very easy to turn off the alarm.

In view of the foregoing, there is a demand for an alarm clock that is superior to currently available alarm clocks. There is a demand for an alarm clock that is more effective in waking up a user than prior art alarm clocks. There is a demand for an alarm clock fully awakens a person before they can turn them off. There is a demand for an alarm clock that engages a person to interact more to awaken them even more. There is yet another demand to provide an alarm clock that moves vigorously when an alarm event occurs to encourage the user to wake up. There is another demand for an alarm clock that can simultaneously sound an audible alarm and move about a user's environment to more effectively wake the user up. There is a demand for an alarm clock that shakes the user awake upon an alarm event.

SUMMARY OF THE INVENTION

The present invention preserves the advantages of prior art alarm clocks. In addition, it provides new advantages not found in currently available alarm clocks and overcomes many disadvantages of such currently available alarm clocks.

A self-moving alarm clock shakes the user awake in addition to providing an audible alarm. The device includes a housing with a cavity therein to house an alarm clock. A housing moving mechanism, which moves the housing from a first position to a second position, is electrically connected to the alarm clock. When an alarm signal is activated by the alarm clock upon an alarm event, the housing moving mechanism is activated to move the housing repeatedly from position to position. A switch on the housing is used to turn off the audible alarm and the housing moving mechanism. Since the switch is located on the housing which is moving, the user must hold the housing during which time the user is shaken awake while they are turning off the alarm switch.

The present invention includes many aspects and features. Moreover, while many aspects and features relate to, and are described in, the context of alarm clock devices, the present invention is not limited to use only in connection with alarm clock devices, as will become apparent from the following summaries and detailed descriptions of aspects, features, and one or more embodiments of the present invention.

Accordingly, one aspect of the present invention relates to an alarm device that includes a first portion housing an alarm component for producing an audible sound upon actuation in response to an alarm event and a second portion housing a vibration-inducing component for producing shaking movement in the device upon actuation in response to an alarm event. The first and second portions are pivotably engaged with one another to permit swiveling movement of one of either the first or second portion relative to the other portion. Furthermore, in this aspect of the invention, the first and second portions are pivotable between a first position, wherein opposing surfaces of each of the first and second portions are substantially fully aligned with one another, and a second position, wherein opposing surfaces of each of the first and second portions are substantially exposed.

In variations of this aspect, the alarm component and the vibration-inducing component may be actuatable in response to the same alarm event; the alarm event may be a selected time of day; the alarm device may further comprise a plurality of protrusions arranged exteriorly on the first and second portions for cushioning the device during shaking movement; the alarm device may further comprise a power source for providing electrical energy to the alarm component and the vibration-inducing component, which power source may be a rechargeable battery power source; the alarm component may comprise a mechanical alarm clock; the alarm component may comprise an electronic alarm clock; the vibration-inducing component may comprise an eccentrically mounted weight, the rotation of which is powered by a motor housed within the second portion; the first and second portions may jointly define a generally spherical shape when oriented in the first position; and a time display housed in the first portion may be revealed when the first and second portions are oriented in the second position.

Another aspect of the invention relates to a method of using an alarm device to wake a person. An exemplary such method includes providing the alarm device, wherein the alarm device comprises a first portion housing an alarm clock component and a second portion housing a vibration-inducing component; and setting the alarm device to be actuated at a preset alarm time such that, at the preset alarm time, the alarm clock component is actuated to produce an audible sound and the vibration-inducing component is actuated to produce shaking movement in the device. Furthermore, in this aspect of the invention, the first and second portions are pivotably engaged with one another to permit swiveling movement of one of either the first or second portion relative to the other portion to reveal a time display housed in the first portion.

In variations of this aspect, the alarm device may further comprise a plurality of protrusions arranged exteriorly on the first and second portions for cushioning the device during shaking movement; the alarm device may further comprise a power source for providing electrical energy to the alarm clock component and the vibration-inducing component; the alarm clock component may comprise a mechanical alarm clock; the alarm component may comprise an electronic alarm clock; the vibration-inducing component may comprise an eccentrically mounted weight, the rotation of which is powered by a motor housed within the second portion; and the method may further comprise the step of deactivating the alarm device to cease production of the audible sound and the shaking movement.

Another aspect of the invention relates to an alarm device that includes a first portion housing an alarm component for producing an audible sound upon actuation in response to an alarm event, a second portion housing a vibration-inducing component for producing shaking movement in the device upon actuation in response to an alarm event, and a plurality of protrusions arranged exteriorly on the first and second portions for cushioning the device during shaking movement. The first and second portions are pivotably engaged with one another to permit swiveling movement of one of either the first or second portion relative to the other portion between a first position, wherein opposing surfaces of each of the first and second portions are substantially fully aligned with one another, and a second position, wherein opposing surfaces of each of the first and second portions are substantially exposed. A time display housed in the first portion is revealed when the first and second portions are oriented in the second position.

Another aspect of the invention relates to an alarm device substantially as shown and described.

It is therefore an object of the present invention to provide an alarm clock that is superior to currently available alarm clocks.

Another object of the present invention is to provide an alarm clock that is more effective in fully waking up a user than prior art alarm clocks.

A further object of the present invention is to provide an alarm clock that moves vigorously when an alarm event occurs.

Yet another object of the present invention is to provide an alarm clock that can simultaneously sound an audible alarm and continuously move about a user's environment to more effectively wake the user up.

Another object of the present invention is to provide an alarm clock that a user must chase around and capture upon an alarm event.

Another object of the present invention is to provide an alarm clock that shakes the user awake upon an alarm event.

In addition to the aforementioned aspects and features of the present invention, it should be noted that the present invention further encompasses the various possible combinations and subcombinations of such aspects and features.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
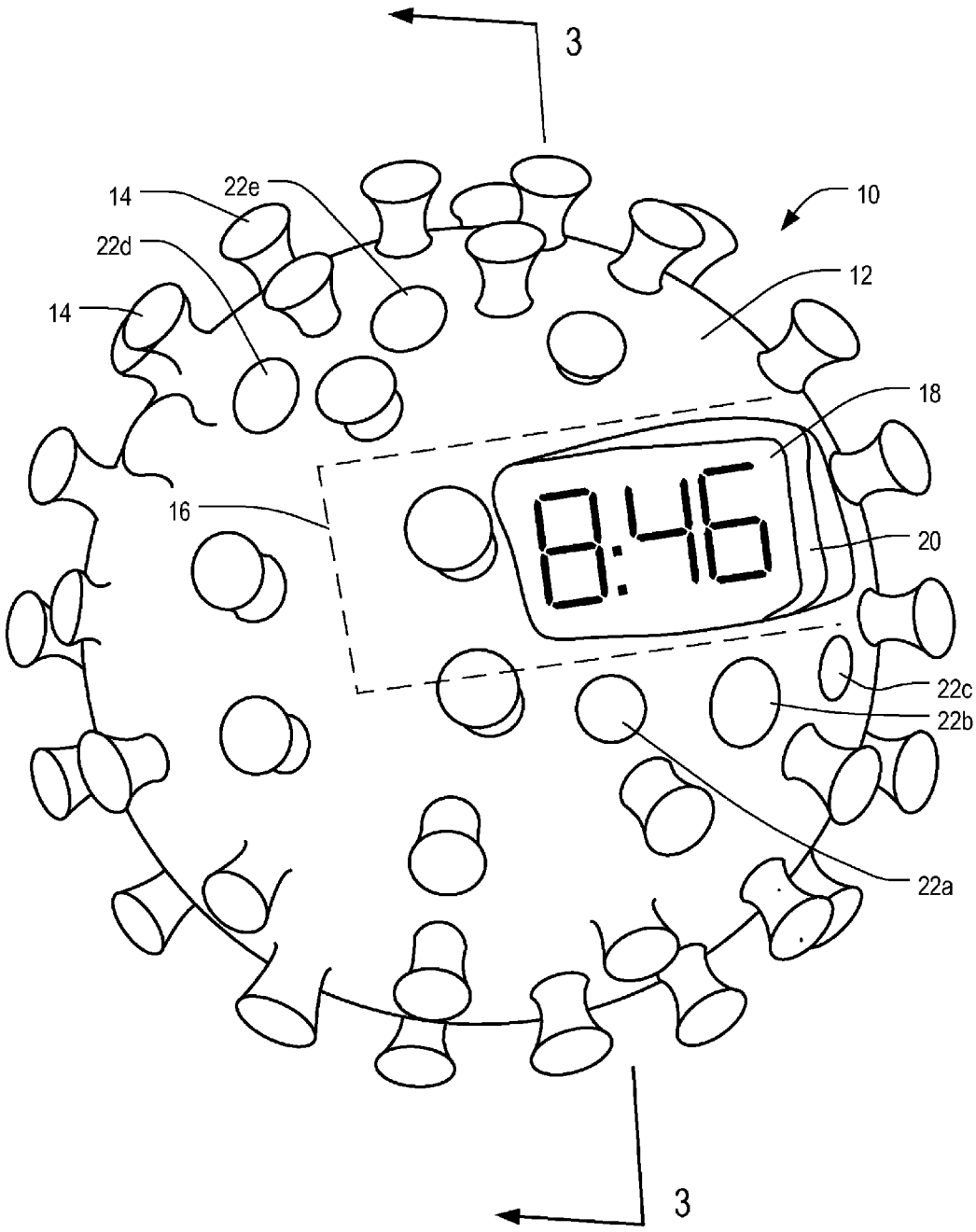
FIG. 1 is a front perspective view of an alarm clock device in accordance with the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

Turning first to FIG. 1, a front perspective view of an alarm clock device 10 in accordance with the present invention is shown. A new and novel alarm clock device 10 includes a housing 12 with, preferably, a number of outwardly emanating protrusions 14 therefrom. These protrusions 14 help provide cushioning of the device 10 when it is moving about, as will be described in detail below. It should be understood that the device 10 is shown in the configuration of a generally spheroid structure with protrusions 14 thereon, however, the device 10 can be provided in any type of configuration, such as a cube without protrusions (not shown). Any configuration, with or without protrusions 14, are considered to be within the scope of the present invention.

Still referring to FIG. 1, an alarm clock component 16 is disposed within the housing 12, which is preferably of the electronic type for compactness and ease of manufacture. The alarm clock component 16 includes a display 18 which is visible through a window 20 in the housing 12. It is possible that the display 18 is a separate unit that is affixed to the outside of the housing 12 and electrically connected to the alarm clock component 16 via electrical wires, or the like. For example, a number of control buttons 22*a-e* are located on the housing 12 for controlling the setting of the current time, selection of an alarm time, setting an alarm and turning off of an alarm. An alarm control button, such as button 22*d*, is provided to enable the user to stop the alarm. A "snooze" button, such as button 22*e*, can optionally be used to delay the alarm for a predetermined period of time, such as ten minutes. The foregoing button arrangement is just one example of a button arrangement that can be employed. Any arrangement and configuration of control buttons 22*a-e* can be used and still be within the scope of the present invention. The configuration and arrangement of the buttons in the drawings are just one of many different button controls that can be used with the present invention.

These alarm control buttons 22*a-e* are electrically connected to the alarm clock component 16 residing within the housing 12. Further details of alarm clock components 16 and displays 18 and control buttons 22*a-e* therefore are well known in the art, and they need not be discussed in further detail herein. In fact, alarm clock components 16 are readily available as a separate unit for incorporation into any device that requires clock and alarm features.

Figure 2:
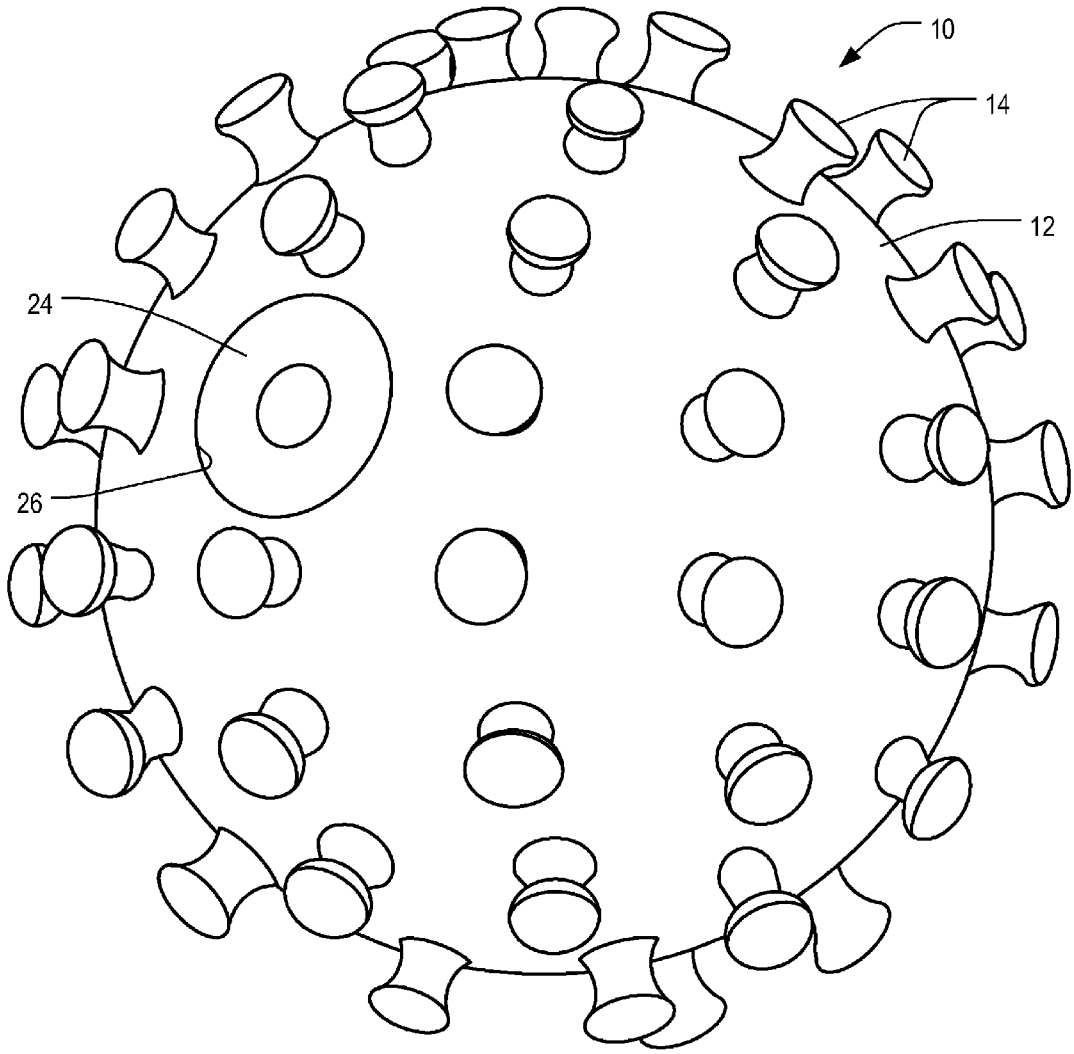
FIG. 2 is a rear perspective view of the alarm clock device of FIG. 1.

Turning now to FIG. 2, a rear perspective view of the alarm clock device 10 of the present invention is shown. A speaker 24 is provided through an aperture 26 in the housing 12, which is electrically interconnected to the alarm clock component 16 so that when an alarm event occurs, the desired sound is audibly heard. This speaker 24 can also be provided completely within the housing 12 rather than being located through an aperture 26 in the housing 12. For example, a speaker 24 may be mounted directly to the alarm clock component 16 within the housing 12. Such a speaker 24 may be of a vibrating cone or piezoelectric type, for example. However, any type of speaker 24 can be used to connect to an audio output of the alarm clock component 16 within the housing 12.

Figure 3:
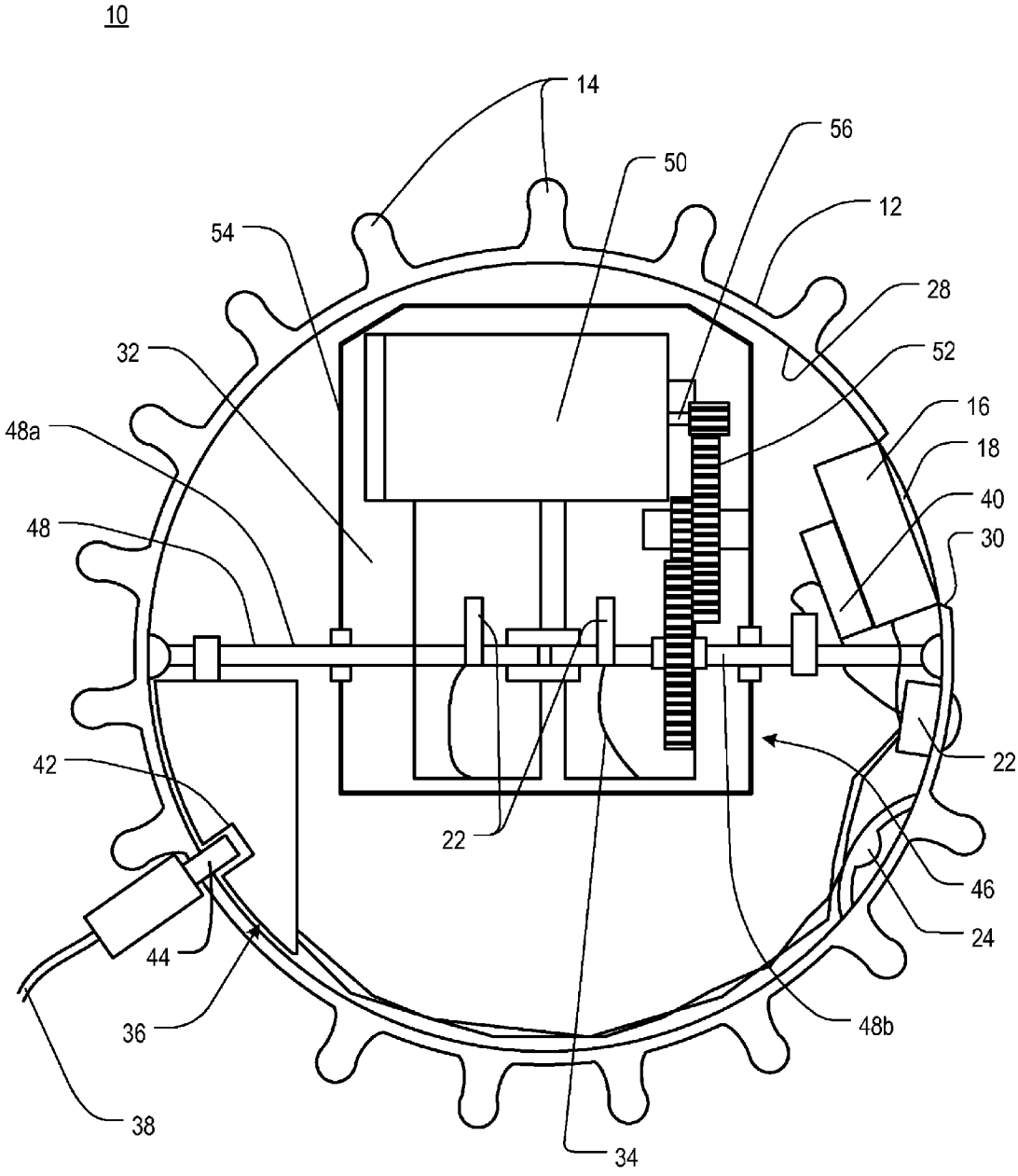
FIG. 3 is a cross-sectional view through the line 3-3 of FIG. 1.
Figure 4:
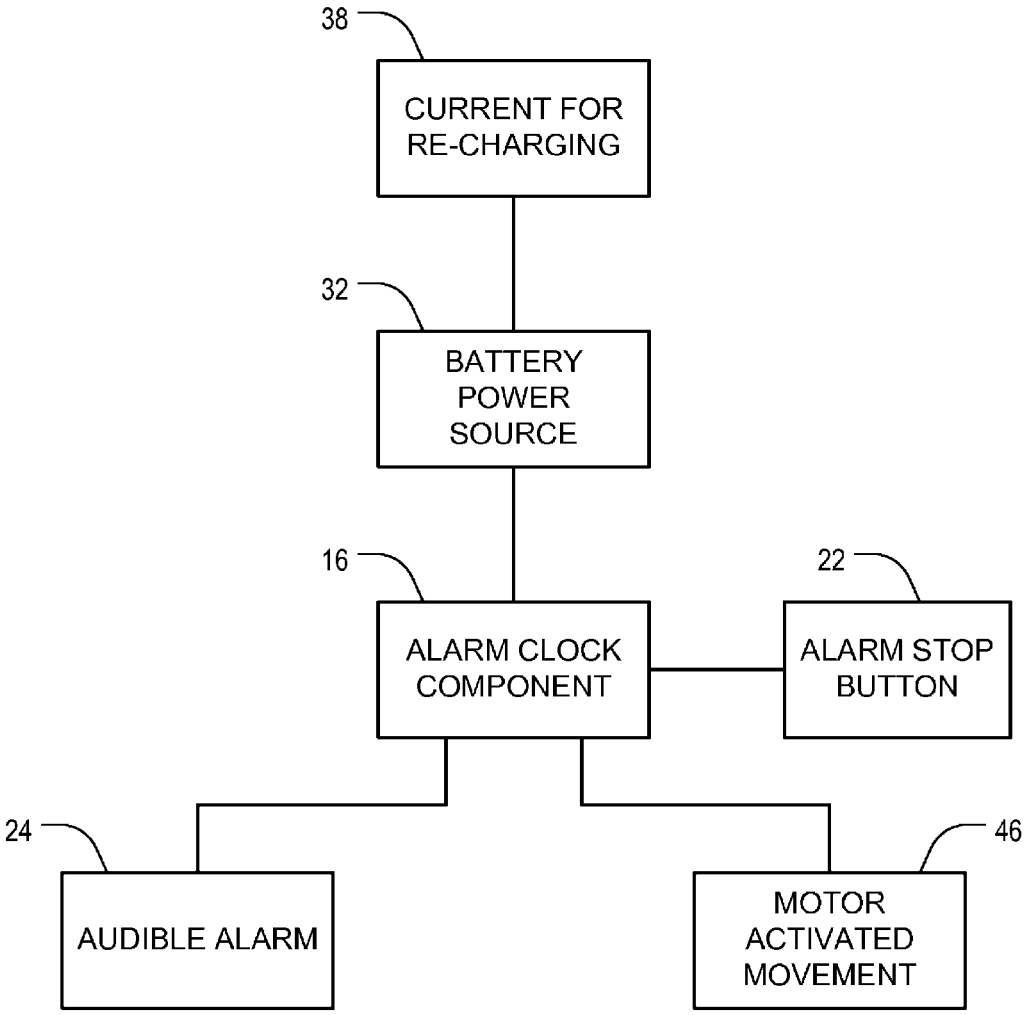
FIG. 4 is a schematic diagram of the electrical system of the alarm clock device of the present invention.

In FIG. 3, a cross-sectional view through the line 3-3 of FIG. 1 shows the details of the interior construction of the alarm clock device 10 of the present invention. FIG. 4 schematically shows the electrical interconnection of the primary components of the present invention. Referring both to FIGS. 3 and 4, the housing 12 includes the outwardly emanating protrusions 14, which can also be seen in FIGS. 1 and 2. An alarm clock component 16, which includes a display 18, is mounted on the interior surface 28 of the housing 12 so that the display 18 can be viewed from outside the housing 12, namely, through a window 30 in the housing 12. A power source 32, such as a pair of vertically oriented batteries, supply power to the alarm clock component 16 via a number of wires 34.

An electrical interface 36 is provided within the housing 12 to electrically communicate with an exterior charging cable 38. An H-bridge type interconnection 40, for example, is preferably employed to control the power to the motor 32. Such an interconnection is well known in the art and need not be discussed in further detail herein.

In the example shown in FIG. 3, a female port 42 is provided in the housing 12 to receive a male plug 44. As a result, charging current is supplied to the power source, namely the batteries 32, so that alarm clock device 10 can operate wirelessly in a non-tethered condition. As stated above, the electrical interface 36 may be a magnetic plug, inductive pad, or an electrical pad, whereby the alarm clock device 10 can be freely separated from the charging source. This is particularly useful when the alarm clock device 10 is being used in conjunction with a docking station, as will be described in detail below in connection with FIG. 6.

A number of buttons, generally referenced in this figure as 22, are electrically interconnected to the alarm clock component 16 so that the operation thereof can be controlled and set. As stated above, the buttons 22*a-e* are used to set the current time, set the alarm time, and turn the alarm on and off. Functionality for "snooze" may also be included. The speaker 24 shown in FIG. 2 can also be seen in FIG. 3, which is also electrically interconnected to the alarm clock component 16. Thus, when the alarm time is reached, an audible alarm is sounded off via the speaker 24. The functionality of the above alarm clock is not limited in any way to the functionality described herein. Any alarm clock feature set can be employed and still be within the scope of the present invention.

Most importantly, a mechanism for vigorously moving the entire housing 12, generally referred to as 46, is also electrically interconnected to the alarm clock component 16 in addition to the speaker 24, as can be seen in FIG. 4. Referring back to FIG. 3, the moving mechanism 46 preferably includes a centrally mounted main axle 48 upon which a motor 50 is eccentrically mounted thereto. The motor 50 is mechanically connected to the axle 48 via a series of gears 52 and resides within a motor housing 54. Thus, when the axle 56 of the motor 50 rotates, the gears 52 will rotate, causing the entire motor 50, within the motor housing 54, to rotate about the main axle 48. Such rotation of a weighted body, namely the motor housing 54, within the housing 12 causes the entire housing 12 to wobble about vigorously. As will be discussed below, this vigorous wobbling enables the present invention to be carried out effectively. A weighted motor housing 54 is just one example how to move the housing 12 to make it shake, wobble, or otherwise move vigorously. Any such structure for causing this action is considered within the scope of the present invention.

Power may be delivered to the motor 50 in a number of different ways. As shown in FIG. 3, main axle 48 is split into two electrically isolated sides 48*a* and 48*b* whereby a positive and negative side of the electricity are delivered respectively thereto. Contact pads 58 within the motor housing 54 maintain contact with the respective sides 48*a*, 48*b* of the main axle 48 to maintain electrical contact with a source of power via cord 38. Thus, the motor housing 54 can rotate freely about the axle while still receiving electricity thereto.

Figure 8:
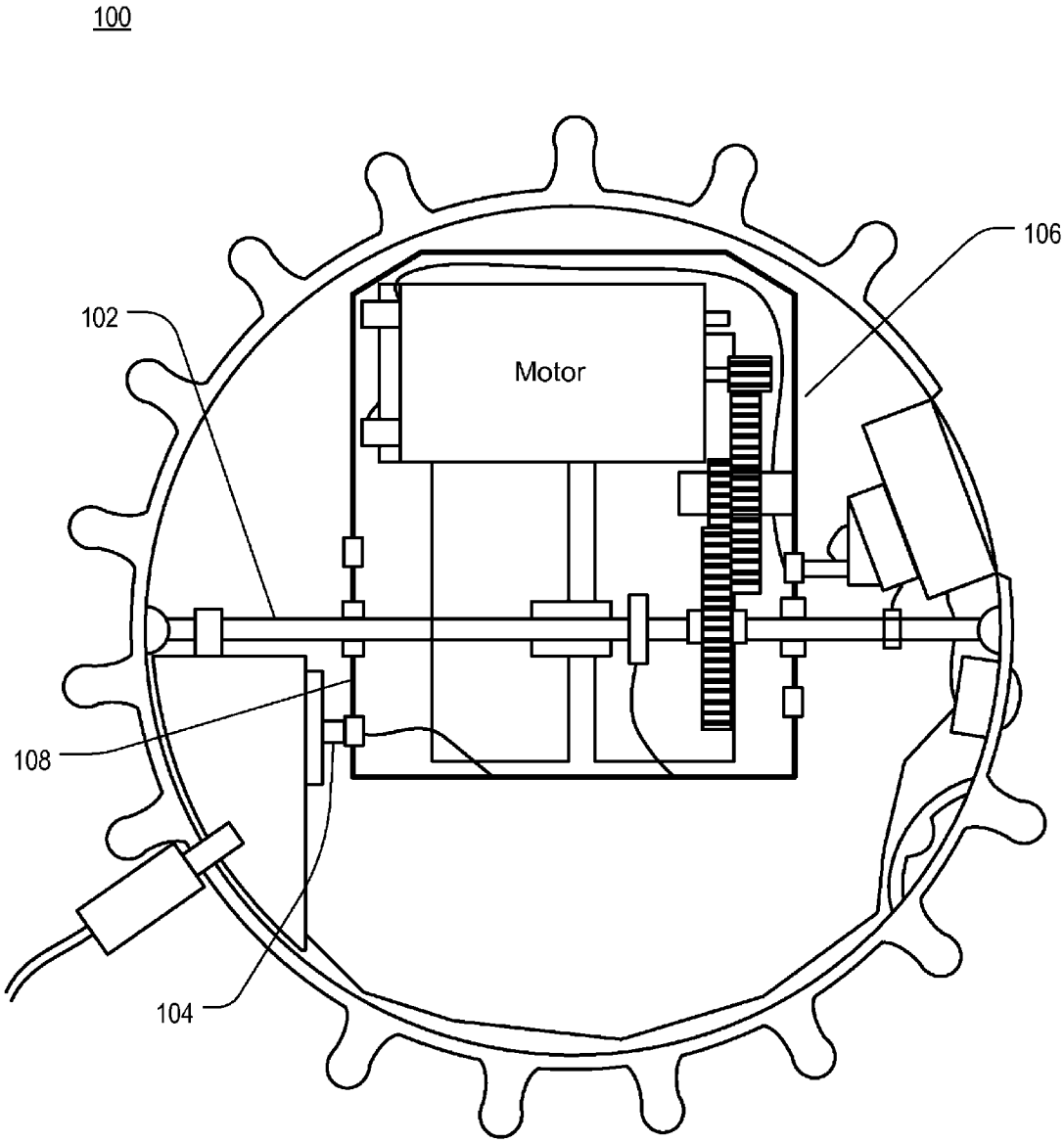
FIG. 8 is a cross-sectional view of an alternative embodiment of the present invention.

Any type of movement, vibration or shaking mechanism for housing 12 can be used. The drawings and discussion here are not intended to limit the overall scope of protection of the present invention. FIG. 8 shows a cross-sectional view of such an alternative embodiment 100 where a different mechanism is used to move the housing 12. This embodiment 100 uses a center axle 102 for electrical "positive" and whereas the electrical "negative" is brought into the housing by a brush pad 104 that continually keeps contact with the moving motor housing 106 through a circular contact point on the outside surface 108 of the housing 106. This is another example of how electricity can be delivered to a moving structure, such as a motor housing 106, to power it within the housing 12 to provide the required moving, shaking, or vibration action.

It should be understood that the eccentrically mounted motor 50 is just one of many different examples that can be used in accordance with the present invention. Common motor assemblies may be used, such as those that use windings in conjunction with magnets. Other mechanisms for vigorous movement of the main housing 12 can be employed.

Figure 5:
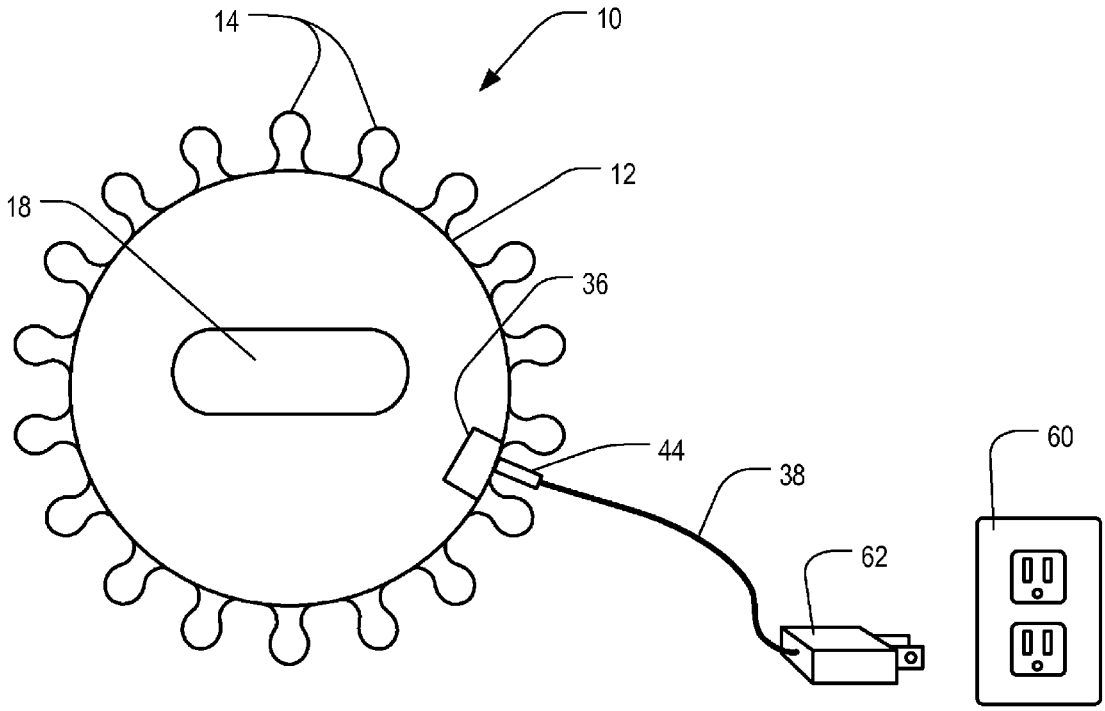
FIG. 5 is a front view of a power supply recharging system for use in connection with the present invention.
Figure 6:
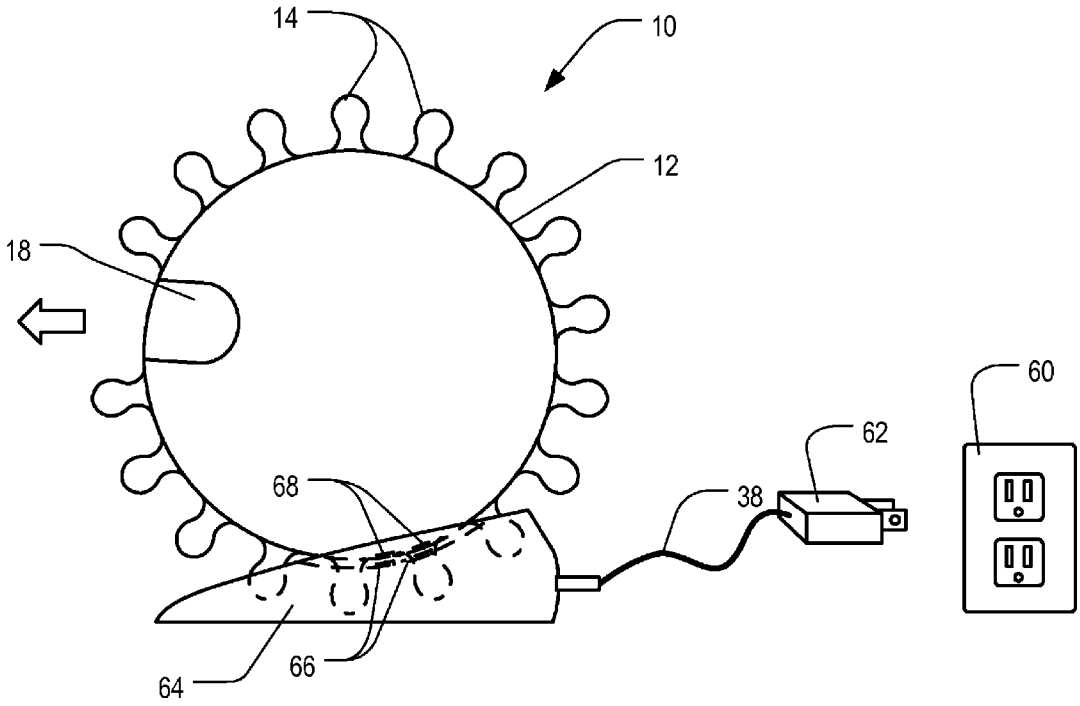
FIG. 6 is a front view of a dock power supply recharging system for use in connection with the present invention.

Turning now to FIGS. 5 and 6, the alarm clock device 10 of the present invention may be stored in a number of different ways. For example, in FIG. 5, the alarm clock device 10 can be simply plugged into house current where a charging current is delivered to the batteries 32 via an electrical interface 44 on the charging cord and an electrical interface 36 in the housing 12. In this example, a plug 44 is used as an electrical interface, as in FIG. 3, to provide charging current from a wall socket 60 via a plug 62 and cord 38. When it is time to use the alarm clock device 10, it is unplugged after charging and simply placed in the desired location. When the alarm time arrives, the alarm clock device 10 will vigorously move about, as described above.

Referring now to FIG. 6, a dock 64 is employed for storage of the alarm clock device 10 when not in use. During this time, the power source, which preferably uses rechargeable batteries, is recharged by house current via the wall plug 62 plugged into a wall outlet 60 with cord 38 and dock 64. The dock 64 includes a pair of frictionless contact pads 66 that electrically communicate with frictionless contact pads 68 on the housing 12 of the alarm clock device 10. As a result, when the alarm clock device 10 is residing on the dock 64, it recharges while it is being neatly stored. As stated above, a magnetic plug or inductive pad can be used to reduce, if not eliminate, the frictional interconnection of housing 12 to the dock 64.

It is highly desirable for the housing 12 to be electrically interconnected to the wall outlet 60 for charging, but to be loosely physically interconnected to the dock 64 so that it may freely launch from the dock 64, for example, in the direction of the arrow when an alarm event occurs. In fact, the housing 12 may launch in any direction, if desired. In particular, vigorous wobbling of the housing 12 will cause the alarm clock device 10 to launch from the dock 64 so that it will immediately begin to move about in a fashion that will require the user to get up out of bed, locate it, chase after it, capture it, get shaken awake, and then turn it off.

Figure 7A:
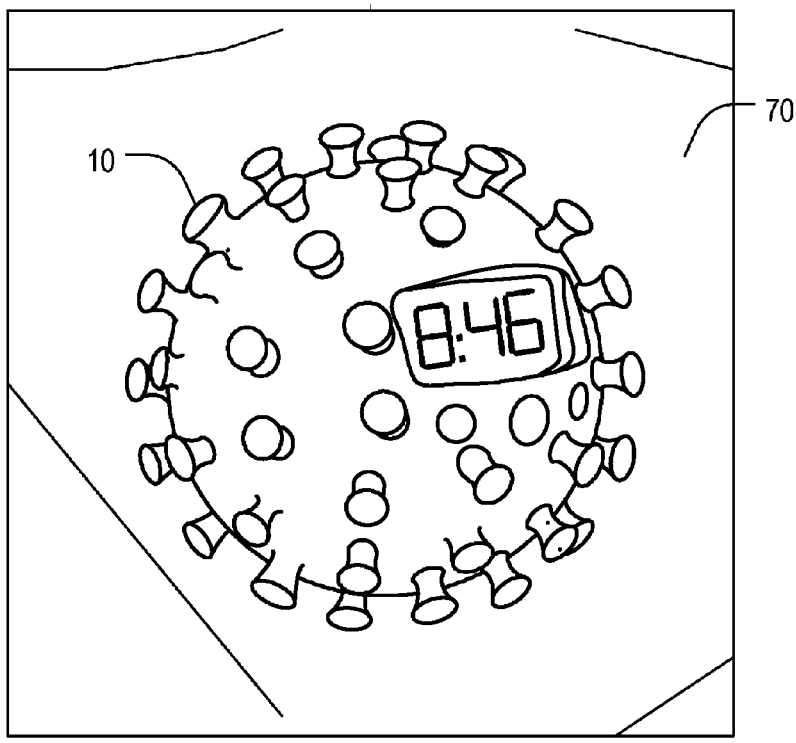
FIGS. 7A-7F show steps of a method of waking a user in accordance with the present invention.
Figure 7B:
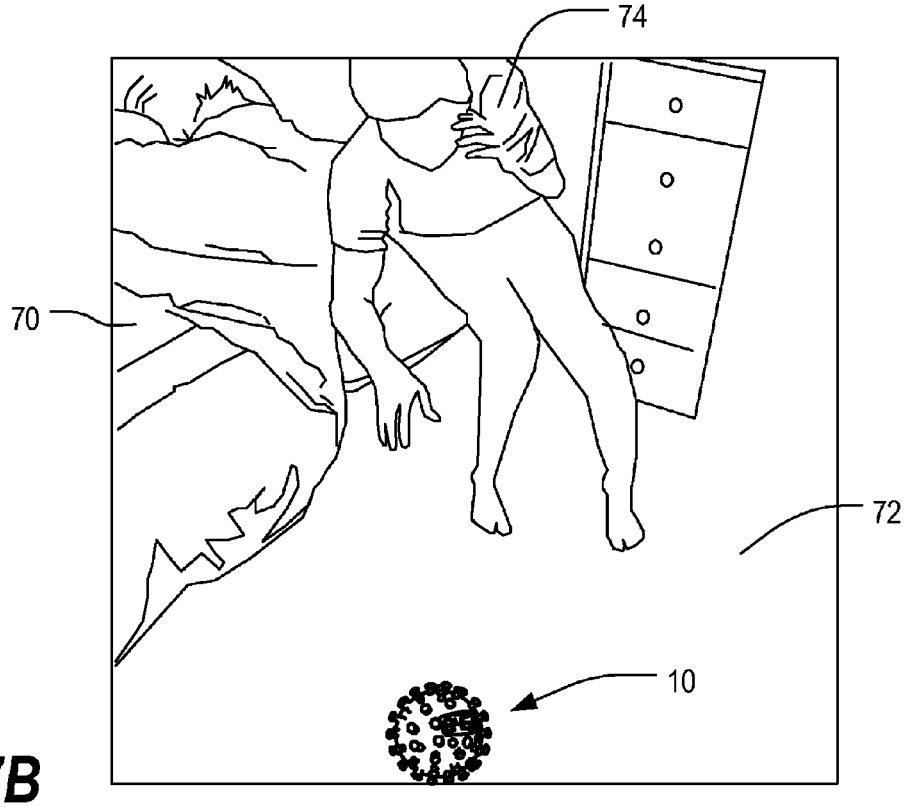

Turning now to FIGS. 7A-7F, the method of waking a user is shown in detail. In FIG. 7A, the alarm clock device 10 of the present invention is set with a desired alarm time. The alarm is then set and the device 10 is positioned where desired, such as on a nightstand next to the user's bed 70. In FIG. 7B, the previously set alarm time is reached and the alarm clock device 10 is launched from a nightstand onto the floor 72 nearby while sounding an audible alarm. The user 74 is required to get out of bed 70 and locate the alarm clock device 10 during which time the device 10 is moving vigorously about the room making it difficult for the user 74 to locate and chase around. Even when in a corner or against a wall, the device 10 of the present invention continues to move, making it difficult for the user 74 to locate and pick it up.

Figure 7C:
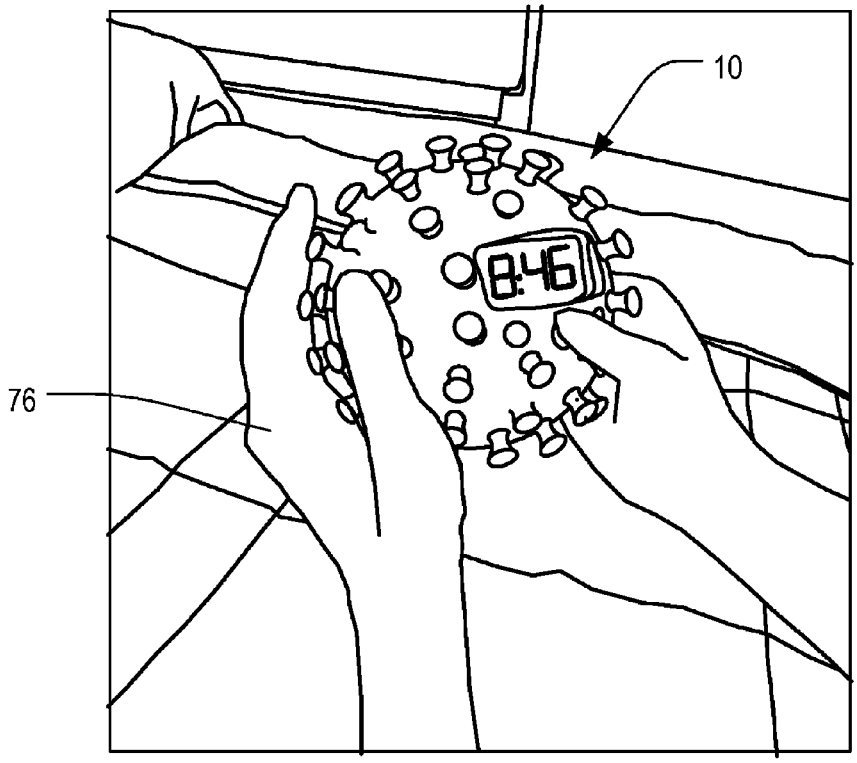
Figure 7D:
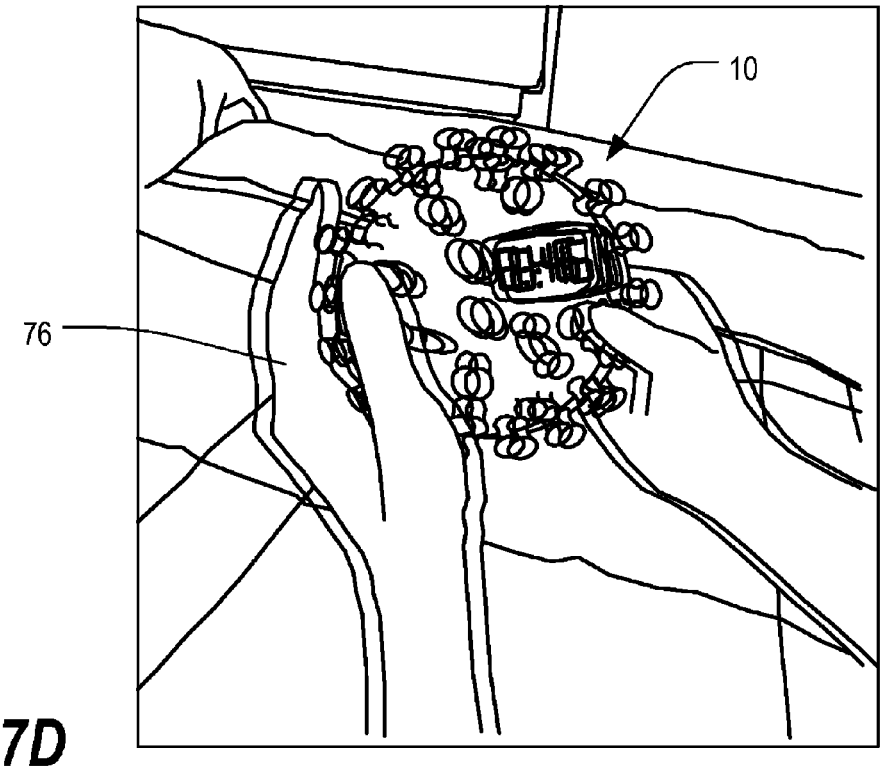

In FIG. 7C, the user 74 has finally located the alarm clock device 10 and has picked it up, and is now holding it in their hands 76. Due to the level of the movement and shaking, the user 74 typically needs to hold the device in both hands 76. In FIG. 7D, the device 10 continues to actively move about gradually shaking the user 74 awake quickly while still sounding the audible alarm. However, the shaking and audible alarm will continue to sound until the alarm switch 22 is turned off.

Figure 7E:
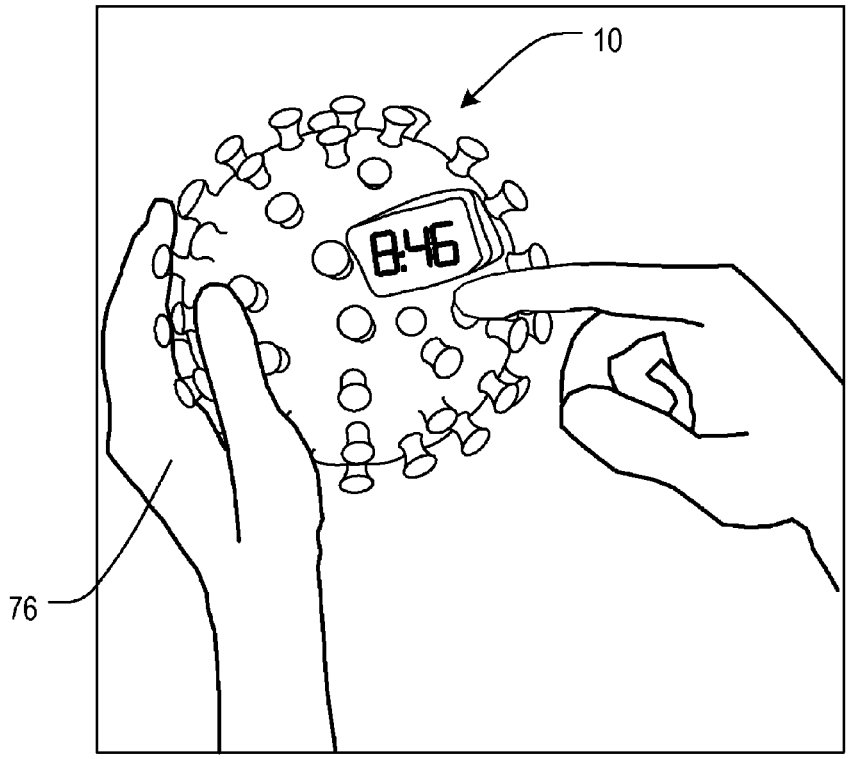
Figure 7F:
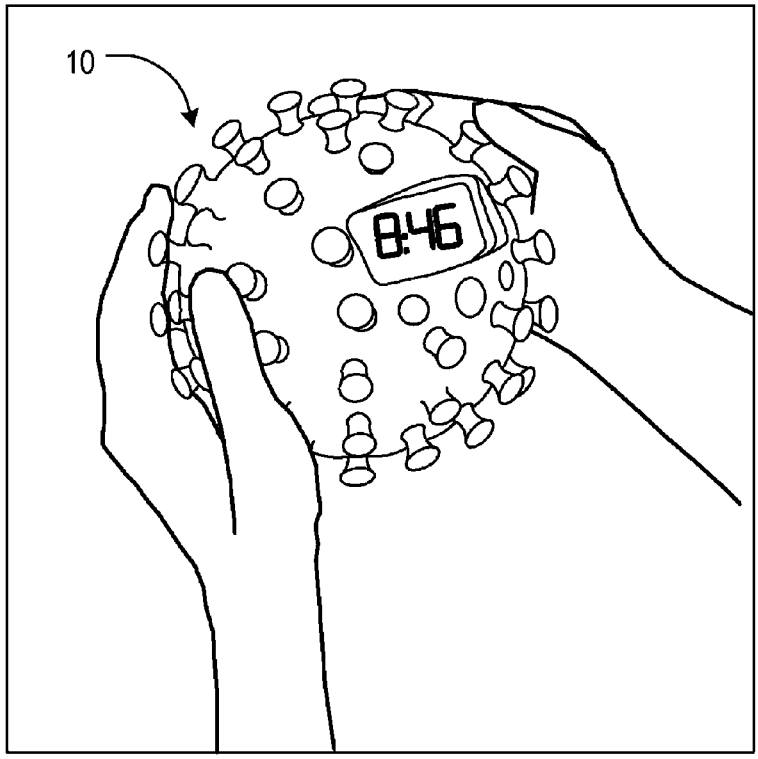

In FIG. 7E, the user 74 has located the alarm switch 22 and has depressed it. As a result, as seen in FIG. 7F, the movement of the alarm clock device 10 has stopped and the audible alarm has ceased to sound. The alarm clock device 10 can now be returned to the desired location in preparation for the next alarm event, such as back in its dock or any location if it is charged up.

This moving mechanism 46 is intended to supplement the hearing sensation of the user 74 with a feeling sensation when waking up. In other words, the user 74 is shaken awake when the device 10 is picked up at the time to shut off the alarm. The ability to shake awake the user 74 while they are holding the device in their hands 76 because they have just retrieved it after moving about the room is new and novel and not found in the prior art. The alarm clock 10 of the present invention requires that the user chase it rather than just try to find it, as is shown in known devices. A key difference is that the user must not only find the device 10, but is required to chase it, then catch it, and perhaps even wrestle with it into order to, in turn, successfully turn it off. Known devices do not require such action on the part of the user.

Also, the moving mechanism 46 shakes the housing 12 to such an extent that it makes a repeated impact to the surface on which it sits, such as a nightstand. This impact is louder than a simple vibration mechanism in known alarm clocks, which are similar to those found in mobile phones. The repeated impact makes a knocking type sound, which is disturbing not only to the user 74, but to his or her neighbors. This encourages the user 74 to quickly locate the alarm clock device 10 of the present invention, get shaken awake, and then turn it off.

The alarm clock device 10 of the present invention can be made of many different types of materials, such as plastic and metal. A plastic or rubber housing 12 is preferably used to avoid damage to surrounding items, such as furniture. The housing 12 may be brightly colored and may include lights, such as those of the flashing type, to enhance the overall aesthetic appeal of the device 10 and to alert the user 74 visually. Such lights may be used as a supplemental or alternative way to waking the user up, as the lights stimulate another sense of the user, namely the visual sense. Spinning or blinking lights are another way to awaken a person though this sense in a manner similar to the sun rising or when someone turns on the lights early in the morning.

Figure 9:
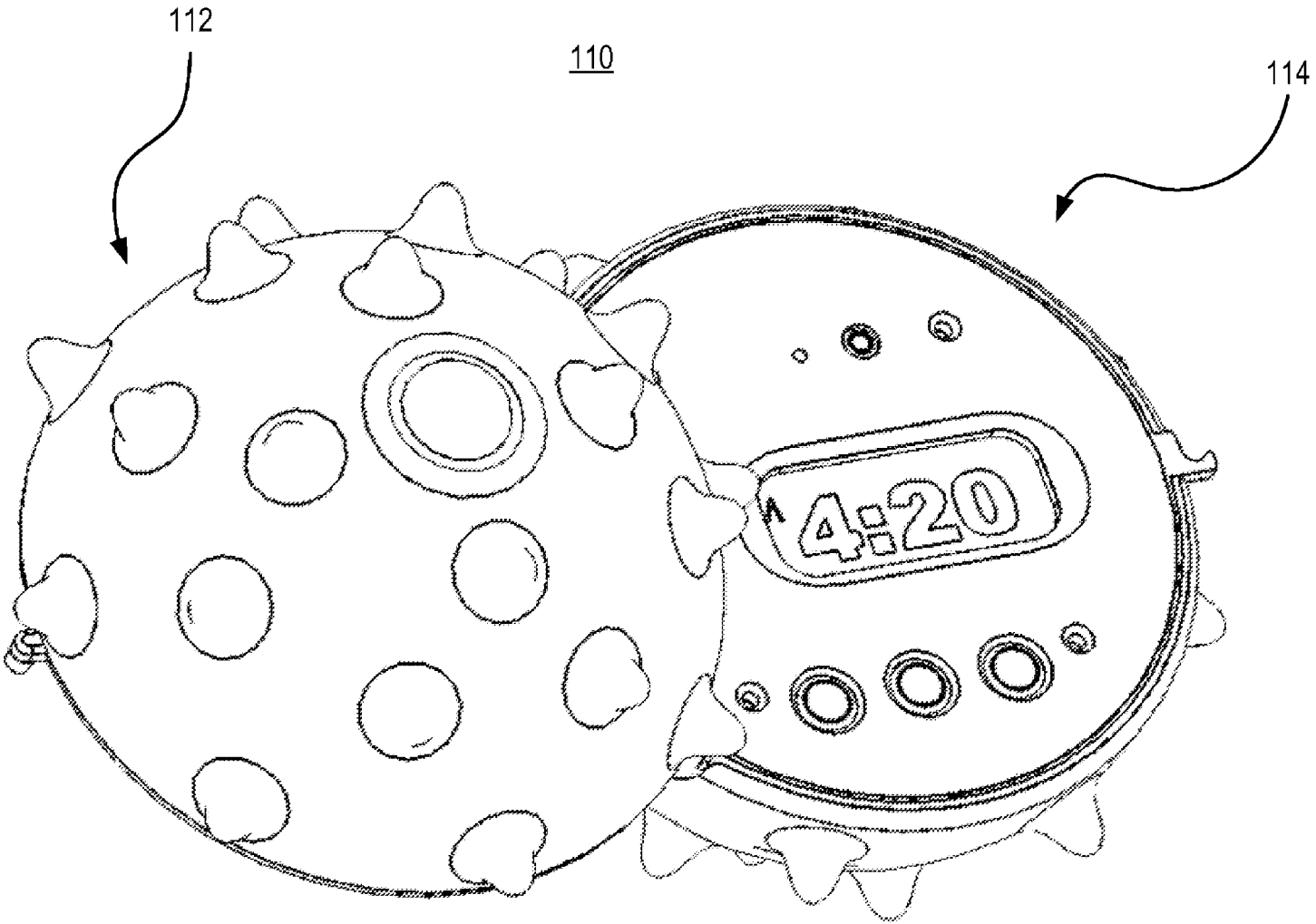
FIG. 9 is a perspective view of an alternative embodiment of an alarm clock device in accordance with the present invention, depicting an open configuration.
Figure 10:
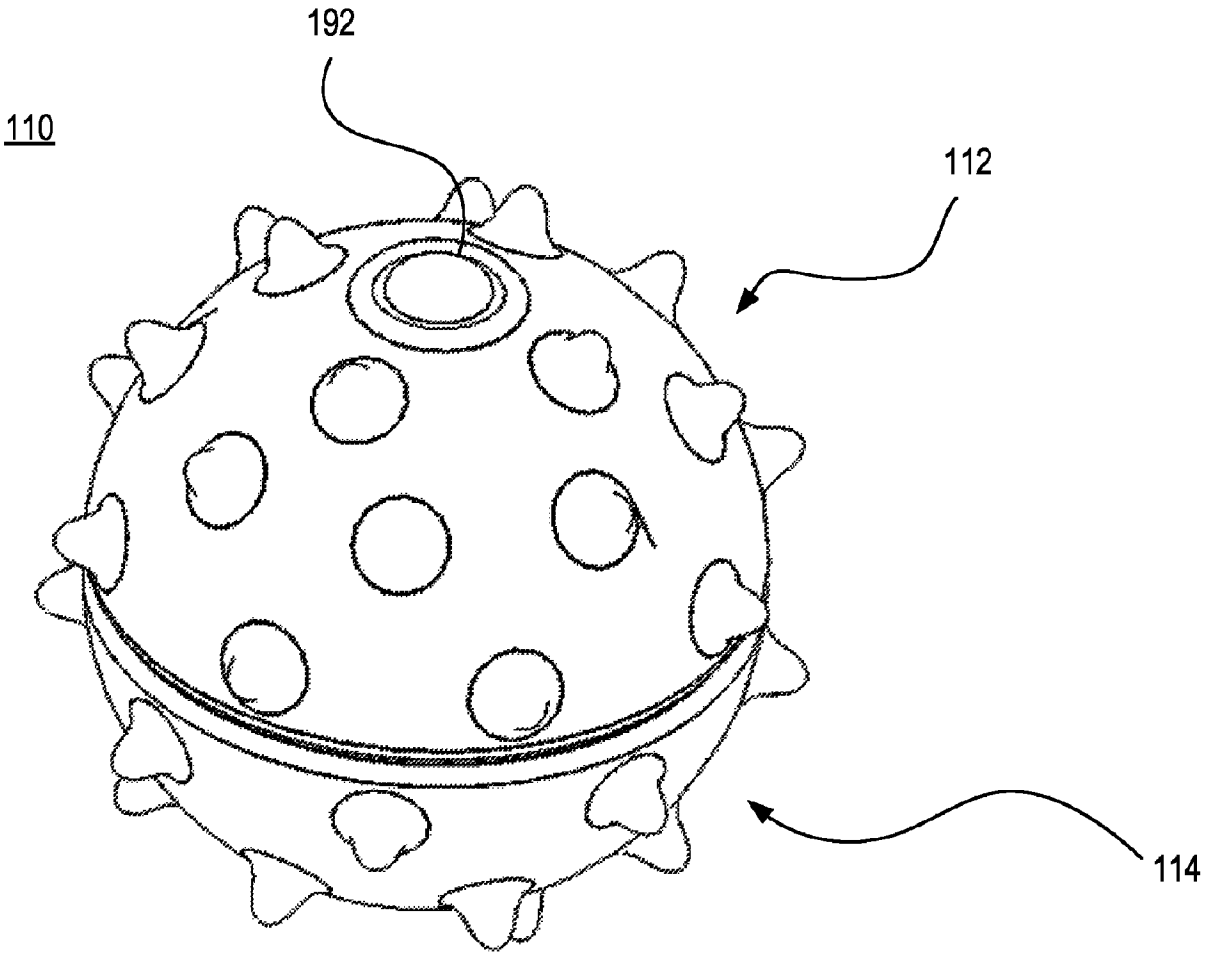
FIG. 10 is a perspective view of the alarm clock device of FIG. 9, depicting a closed configuration.

FIG. 9 is a perspective view of an alternative embodiment of an alarm clock device 110 in accordance with the present invention. The alarm clock device 110 differs from the alarm clock device 10 in some notable ways. For example, rather than have a single housing, the alarm clock device 110 is comprised of two assembly halves, namely, a bottom assembly half 112 and a top assembly half 114. The two assembly halves 112,114 are pivotally coupled together at a pivot point such that each assembly half 112,114 may be swiveled about the pivot point relative to the other assembly half 112,114. By swiveling one of the assembly halves 112,114 relative to the other of the assembly halves 112,114 the alarm clock device 110 may be transitioned between an open configuration, as illustrated in FIG. 9, and a closed configuration, as illustrated in FIG. 10.

Figure 11:
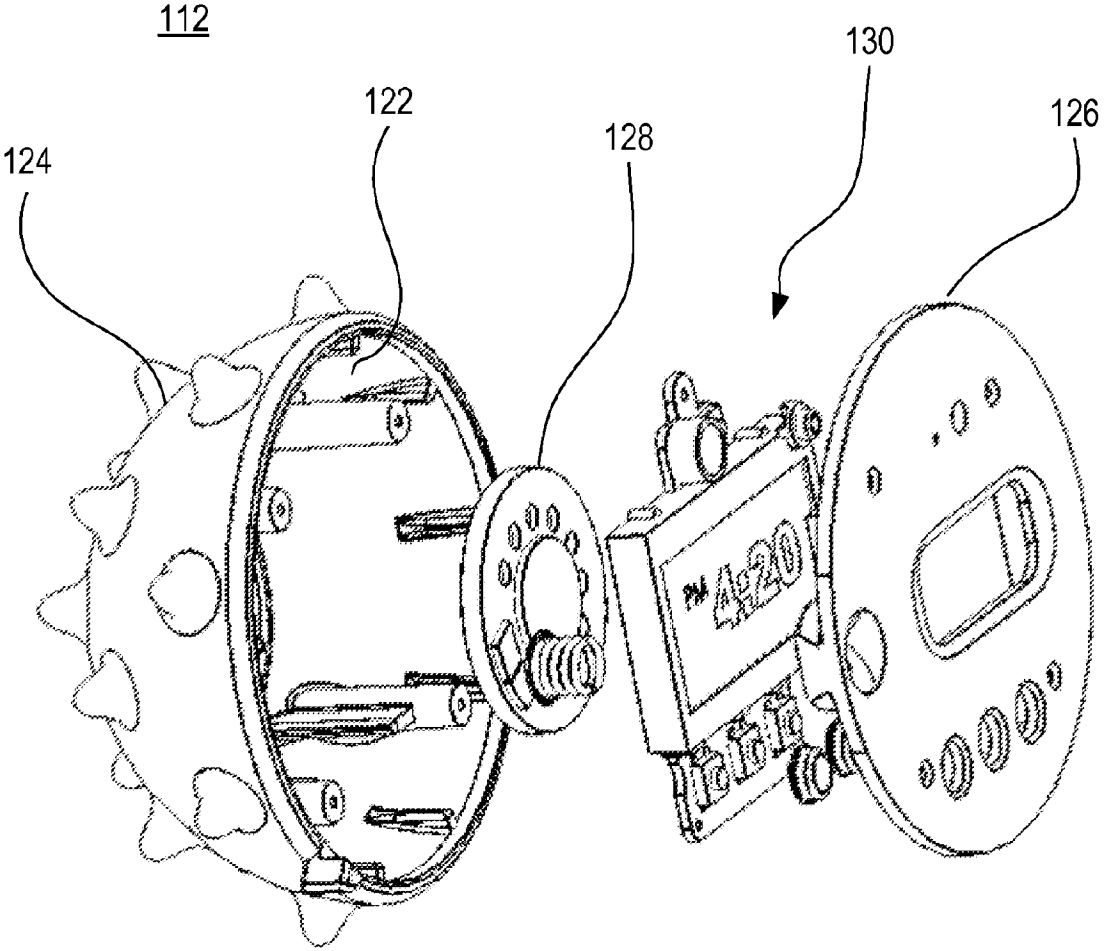
FIG. 11 is an exploded perspective view of a bottom assembly half of the alarm clock device of FIG. 9.

The bottom assembly half 112 includes a bottom housing 122, a bottom soft cover 124, a bottom faceplate 126, a speaker 128, and an alarm clock component 130, as can be seen in FIG. 11, which is an exploded perspective view of the bottom assembly half 112.

Figure 12:
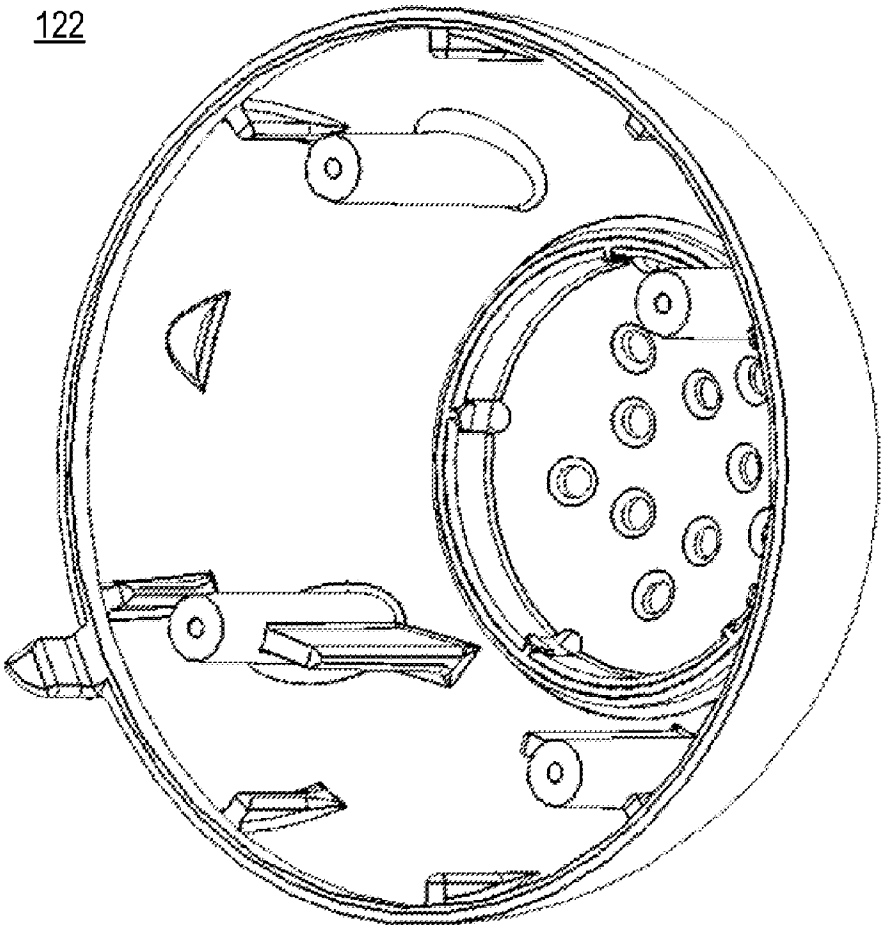
FIG. 12 is a perspective view of a bottom housing of the alarm clock device of FIG. 9.

FIG. 12 is a perspective view of the bottom housing 122 of the alarm clock device 110 of FIG. 9. The bottom housing 122 is preferably plastic, but may be composed of any suitable material. Likewise, the bottom housing 122 is preferably hemi-spherically shaped, but in alternative embodiments may be any suitable shape.

Figure 13:
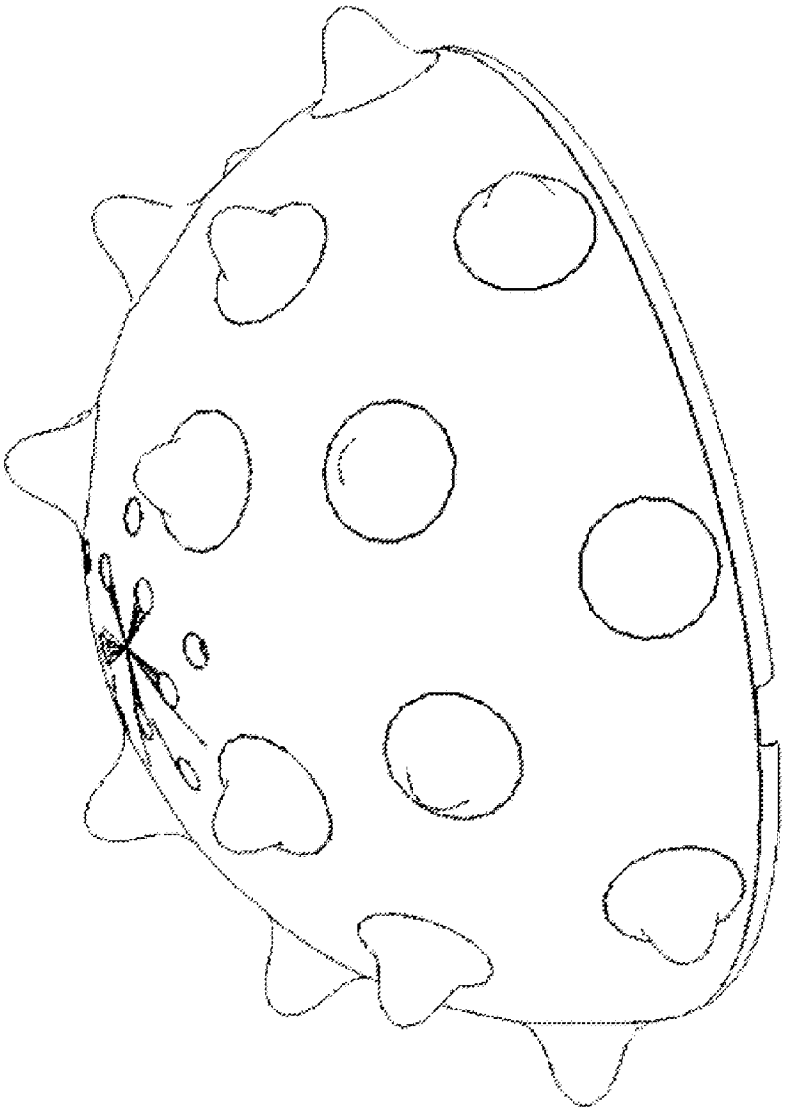
FIG. 13 is a perspective view of a bottom soft cover of the alarm clock device of FIG. 9.

The bottom housing 122 is covered by the bottom soft cover 124 which fits over, and is secured to, the bottom housing 122. FIG. 13 is a perspective view of the bottom soft cover 124 of the alarm clock device 110 of FIG. 9. Preferably, the bottom soft cover 124 is shaped and dimensioned to correspond to the shape and dimensions of the bottom housing 122. Additionally, the bottom soft cover 124 is preferably composed of soft PVC and preferably has a plurality of protrusions projecting from its surface.

Figure 14:
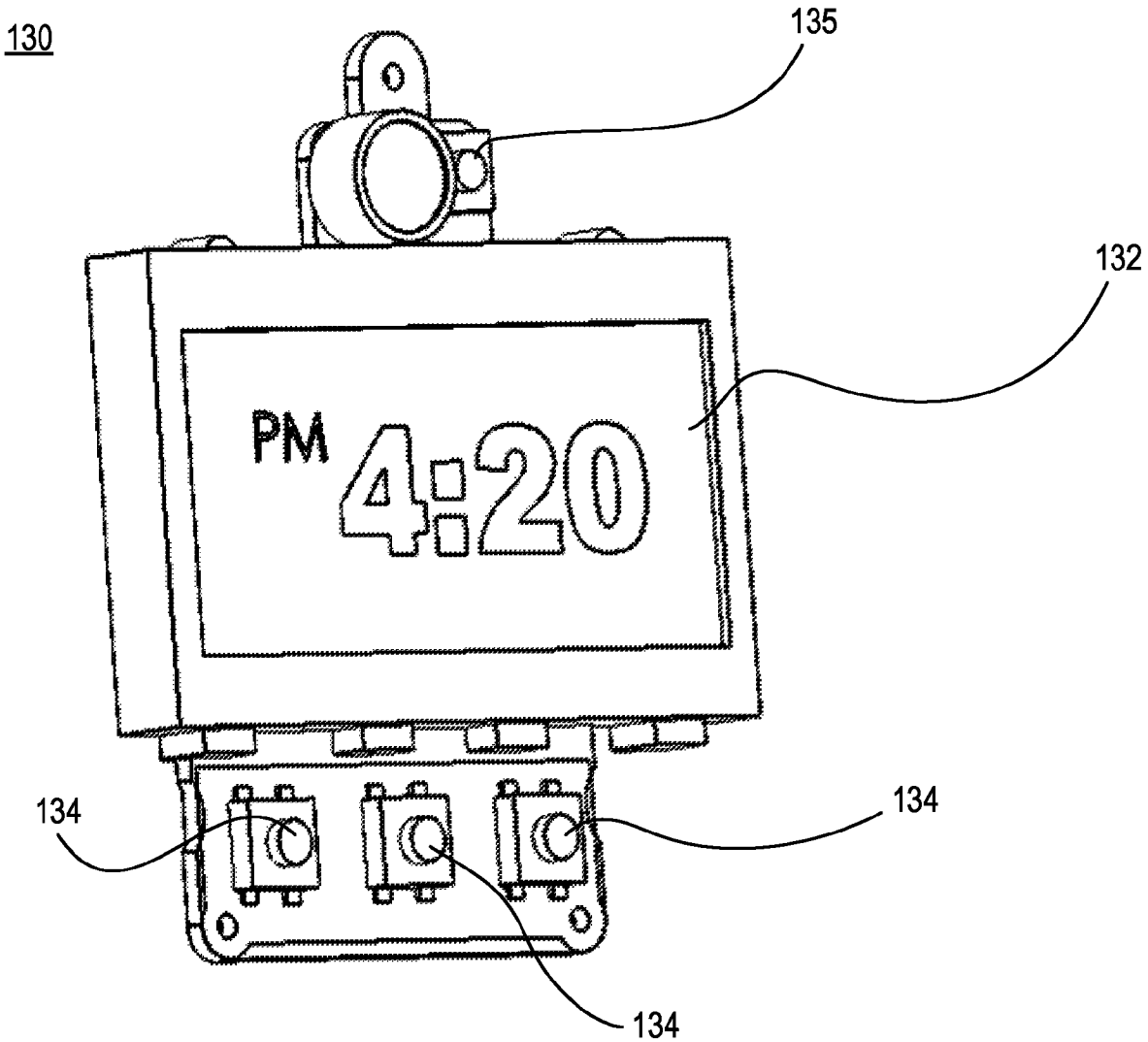
FIG. 14 is a perspective view of an alarm clock component of the alarm clock device of FIG. 9.

FIG. 14 is a perspective view of the alarm clock component 130 of the alarm clock device 110 of FIG. 9. The structure and function of the alarm clock component 130 is generally well known. The alarm clock component 130 includes an LCD display 132 which can display a current time or an alarm time. A plurality of tactile buttons 134 function as alarm control buttons and can be used to set a current time and an alarm time. Preferably, a record tactile button 135 is also included. By actuating the record tactile button 135, a user can record a custom audio stream that may be utilized as an alarm.

The speaker 128 is electronically coupled to the alarm clock component 130 such that the alarm clock component 130 may electronically engage the speaker 128 and cause sound to be produced, as is well known in the art. The speaker is shaped and dimensioned such that it may be snapped in and secured to the bottom housing 122.

Figure 15A:
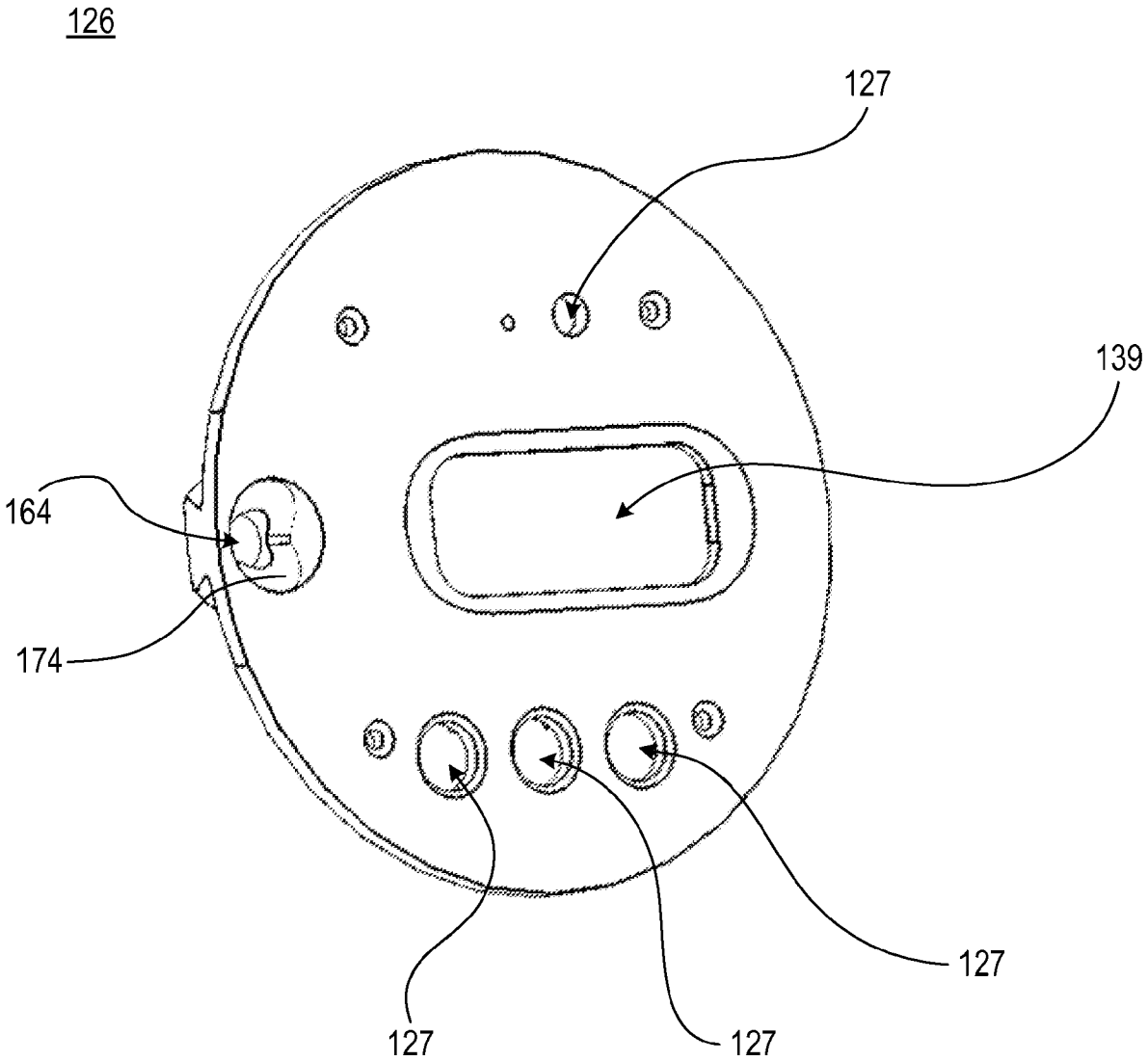
FIG. 15A is a front perspective view of a bottom faceplate of the alarm clock device of FIG. 9.
Figure 15B:
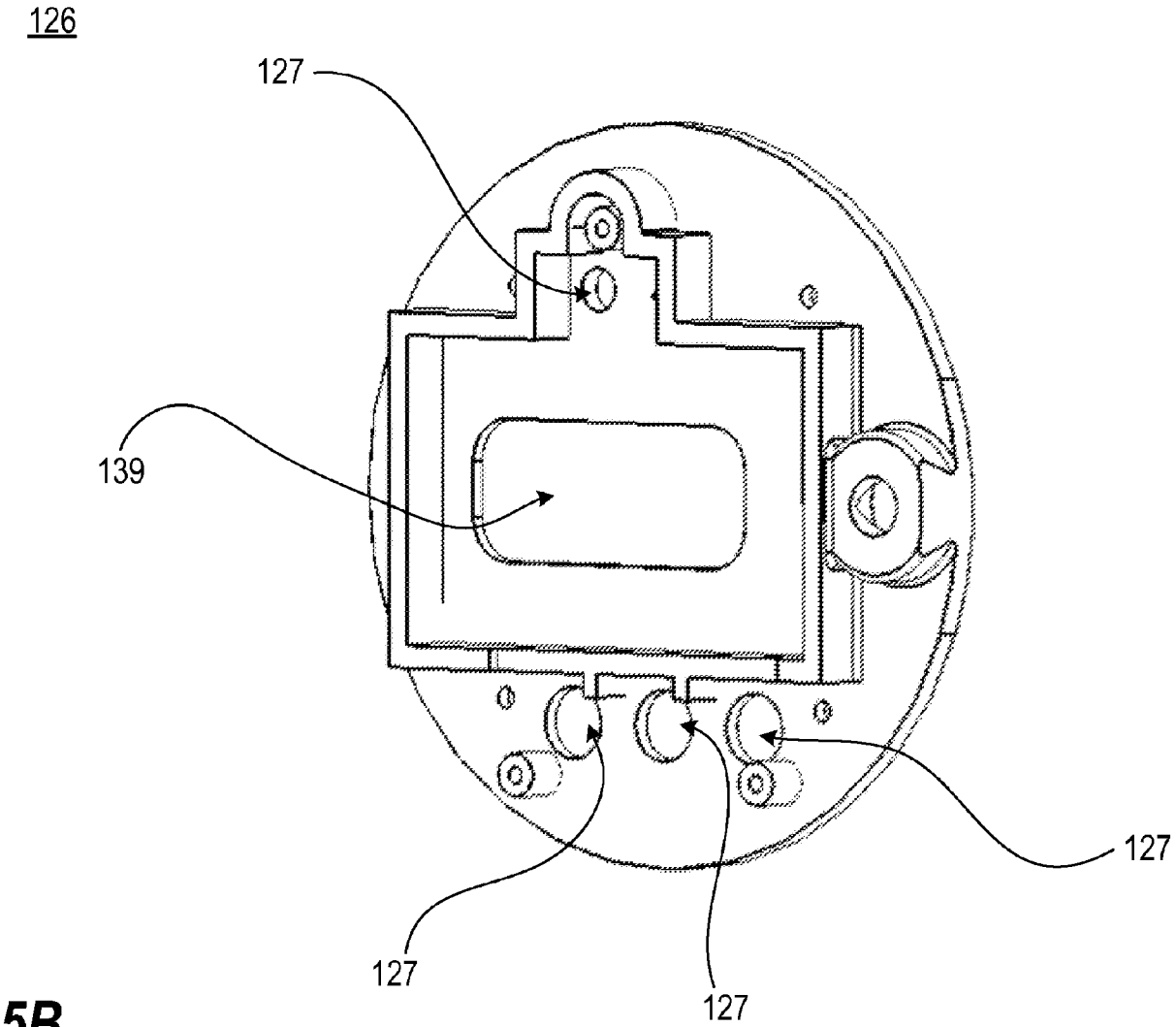
FIG. 15B is a rear perspective view of the bottom faceplate of the alarm clock device of FIG. 9.

FIGS. 15A and 15B are front and rear perspective views, respectively, of the bottom faceplate 126 of the alarm clock device 110 of FIG. 9. As will be appreciated, a plurality of button holes 127 are defined within the bottom faceplate 126 such that buttons 125 may be received therein. Preferably, a record button 136 is also included and received therein.

Figure 16:
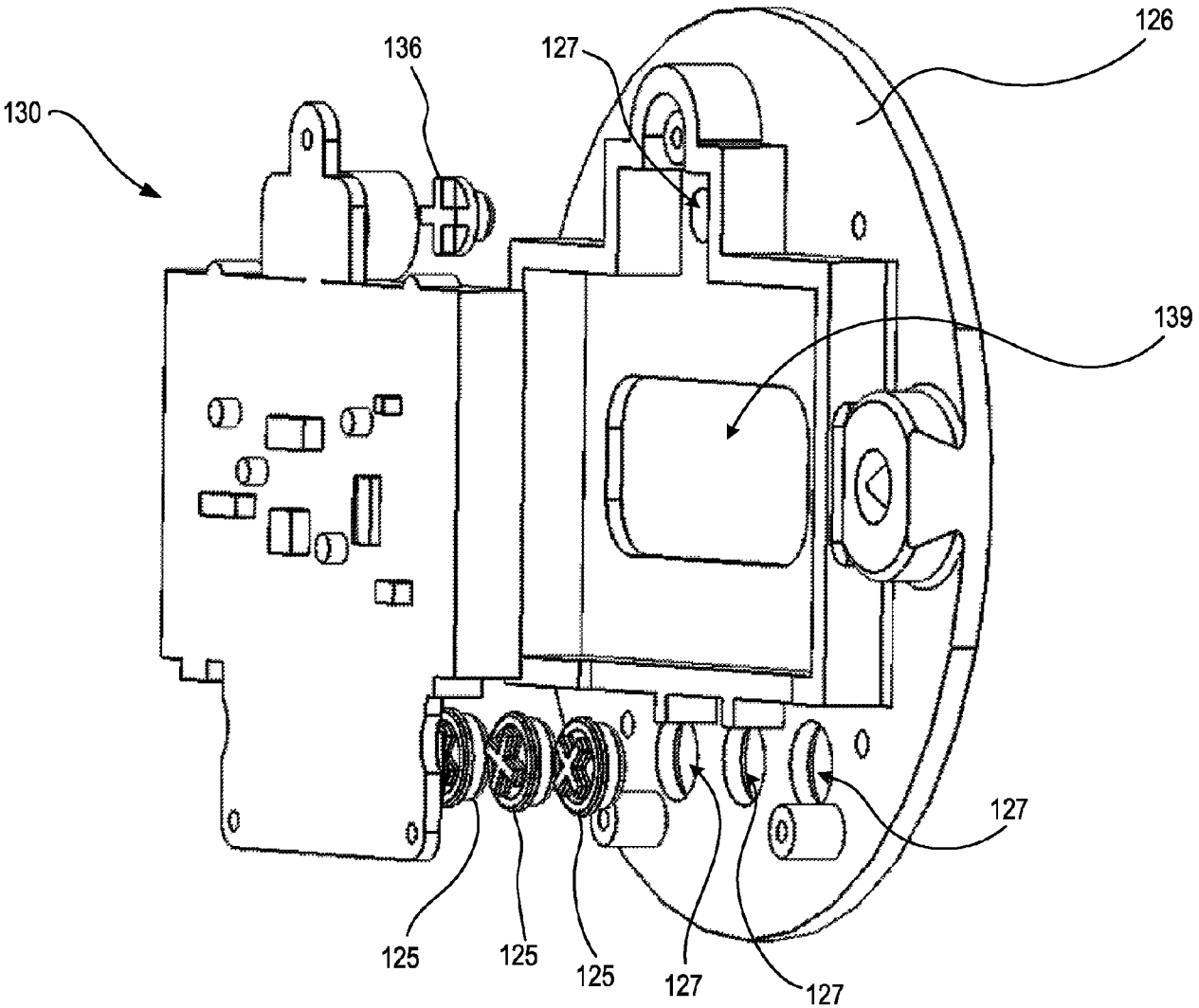
FIG. 16 is a rear exploded perspective view of the bottom faceplate of FIG. 15B illustrating a protruded frame shaped to receive the alarm clock component of FIG. 14.
Figure 17:
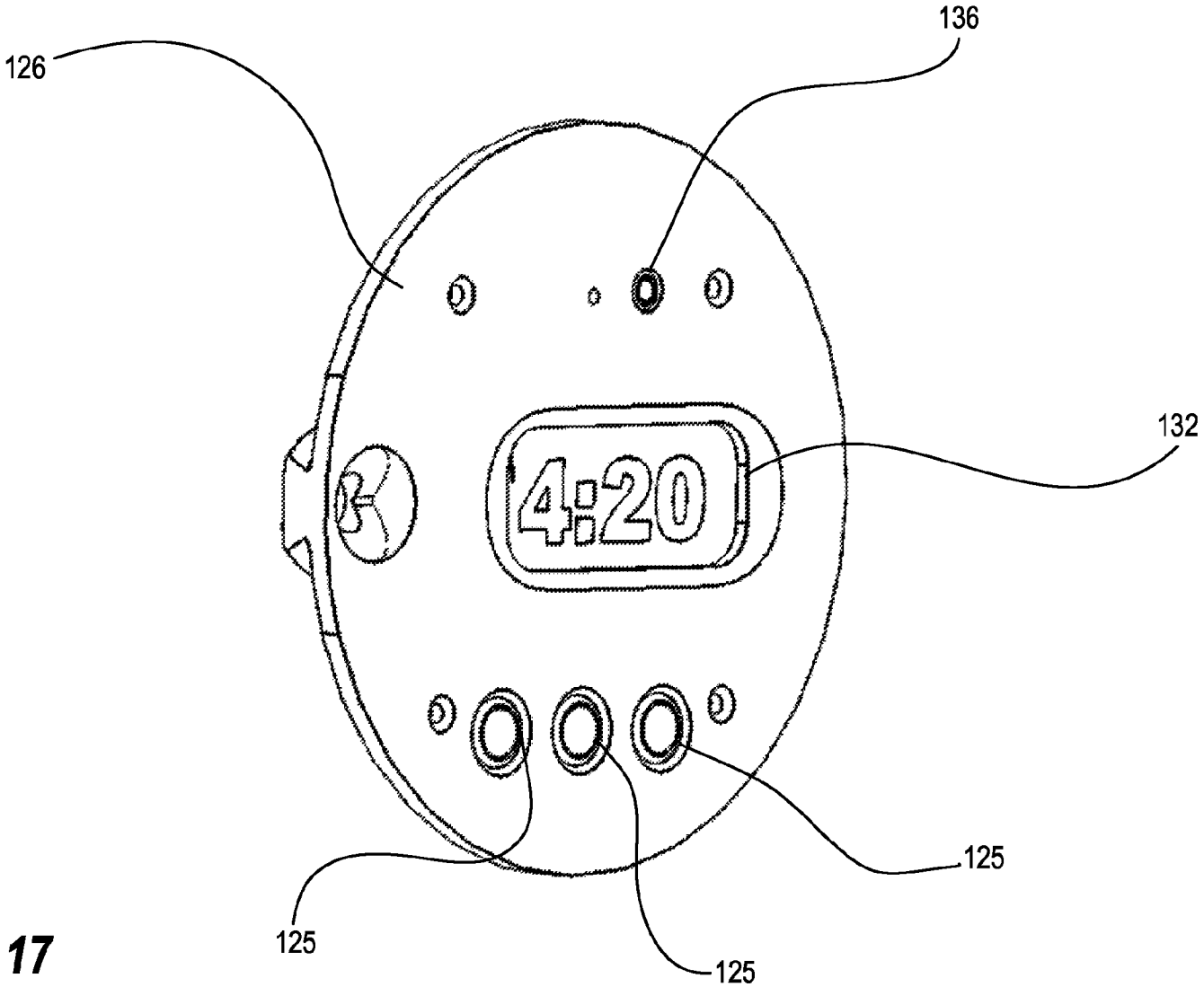
FIG. 17 is a front perspective view of the bottom faceplate of FIG. 15B with the alarm clock component of FIG. 14 received within the protruded frame.

The back of the bottom faceplate 126 includes a protruded frame shaped and dimensioned to receive therein the alarm clock component 130, as can be seen in FIG. 16. When thusly received, each button 125 is received within a respective button hole 127 and is positioned to engage a respective tactile button 134, as can be seen in FIG. 17. Preferably, the record button 136 is also received within a button hole 127 and positioned to engage the record tactile button 135.

The bottom faceplate 126 further has a display opening 139 defined therethrough, through which the LCD display 132 is visible.

The top assembly half 114 includes a top housing 142, a top soft cover 144, a motor assembly 146, and a top faceplate 148.

Figure 18:
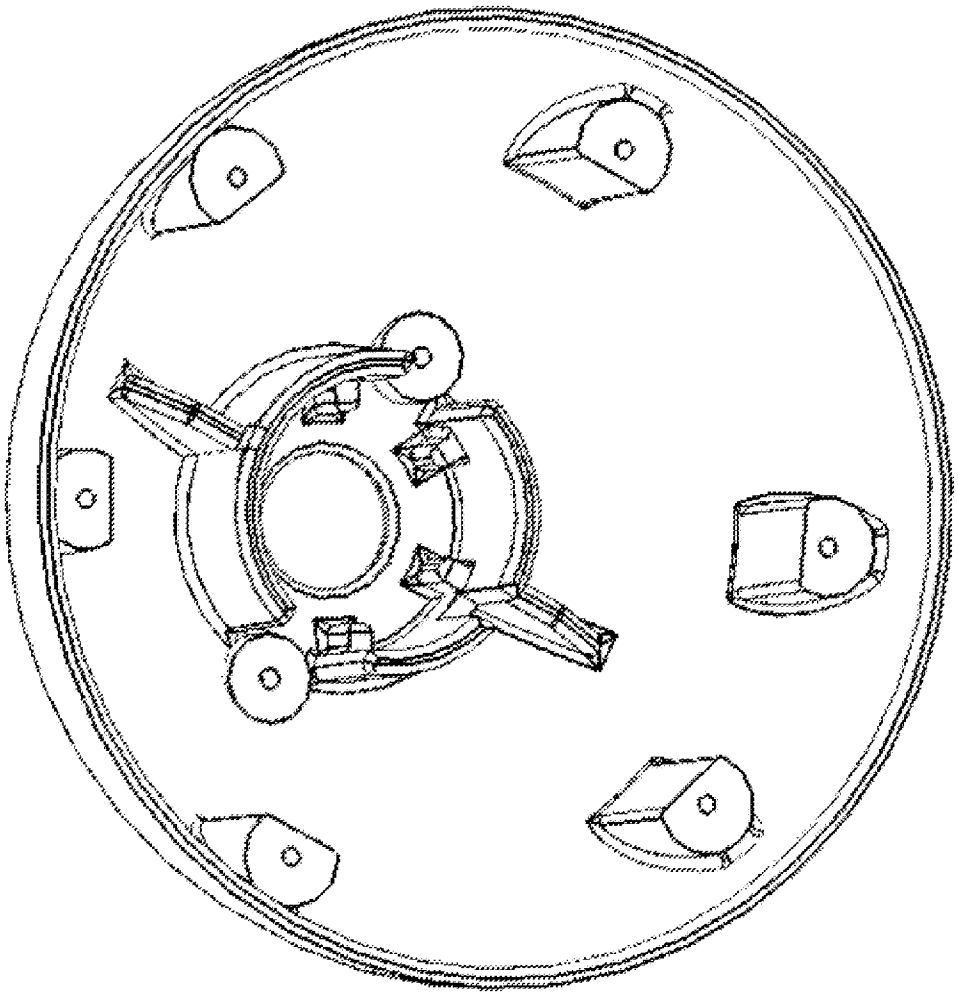
FIG. 18 is a perspective view of a top housing of the alarm clock device of FIG. 9.

FIG. 18 is a perspective view of the top housing 122 of the alarm clock device 110 of FIG. 9. The top housing 142 is preferably plastic, but may be composed of any suitable material. Likewise, the top housing 142 is preferably hemi-spherically shaped, but in alternative embodiments may be any suitable shape.

Figure 19:
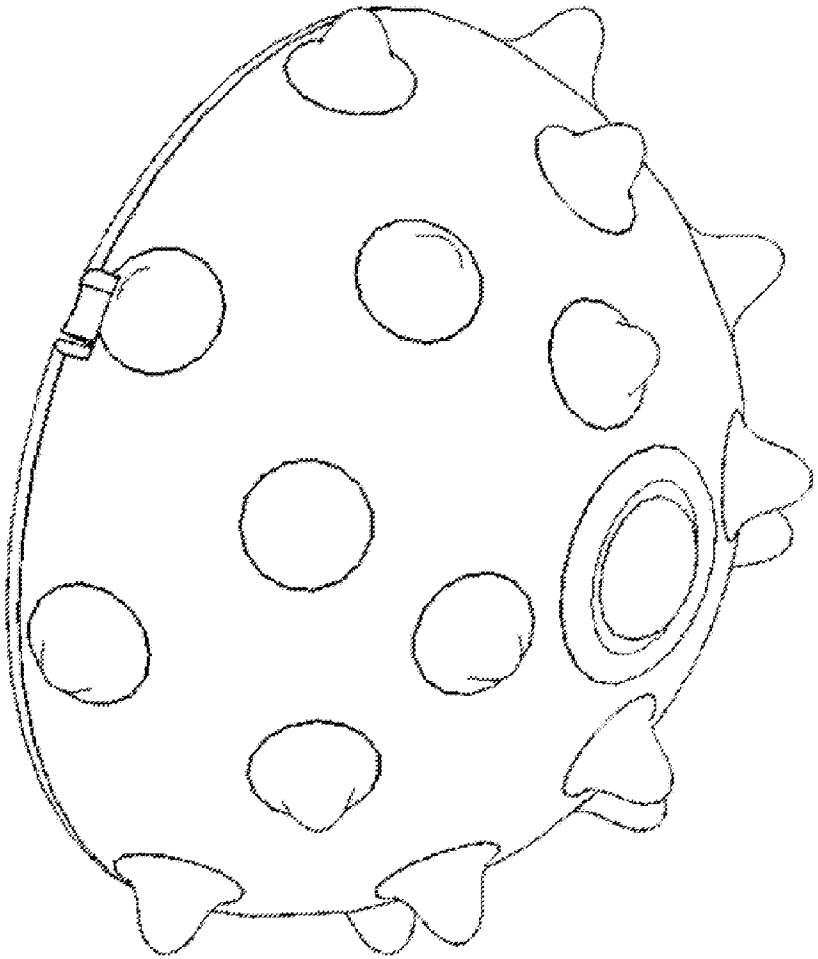
FIG. 19 is a perspective view of a top soft cover of the alarm clock device of FIG. 9.

The top housing 142 is covered by the top soft cover 144 which fits over, and is secured to, the top housing 142. FIG. 19 is a perspective view of the top soft cover 144 of the alarm clock device 110 of FIG. 9. Preferably, the top soft cover 144 is shaped and dimensioned to correspond to the shape and dimensions of the top housing 142. The top soft cover 144 is preferably composed of soft PVC and preferably has a plurality of protrusions projecting from its surface. In addition, as shown in FIG. 10, the top soft cover 144 may include a pushable top snooze button 192 that is arranged to engage a snooze tactile button 159, which is explained more fully below.

Figure 20A:
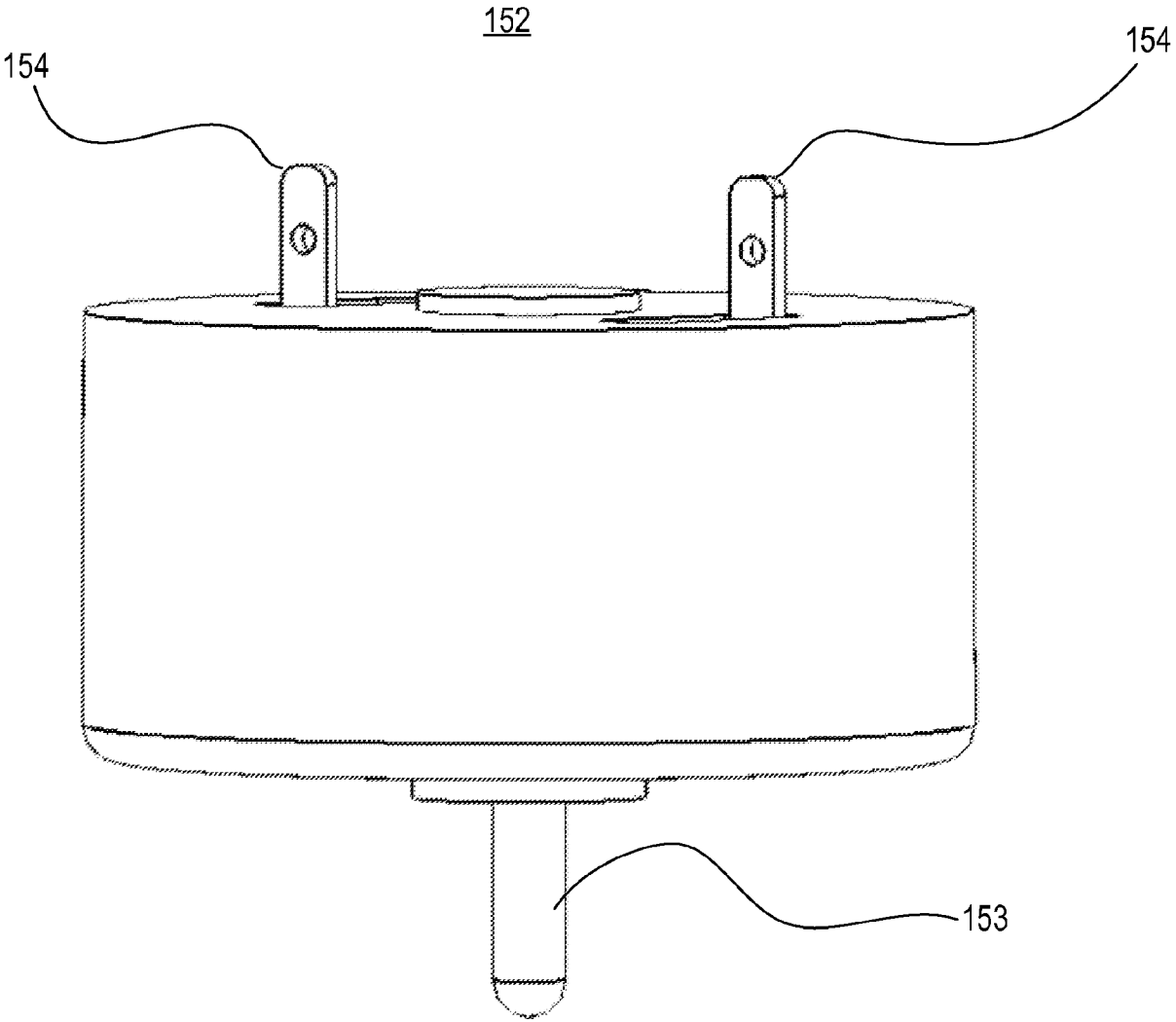
FIG. 20A is a front perspective view of a pancake motor.
Figure 20B:
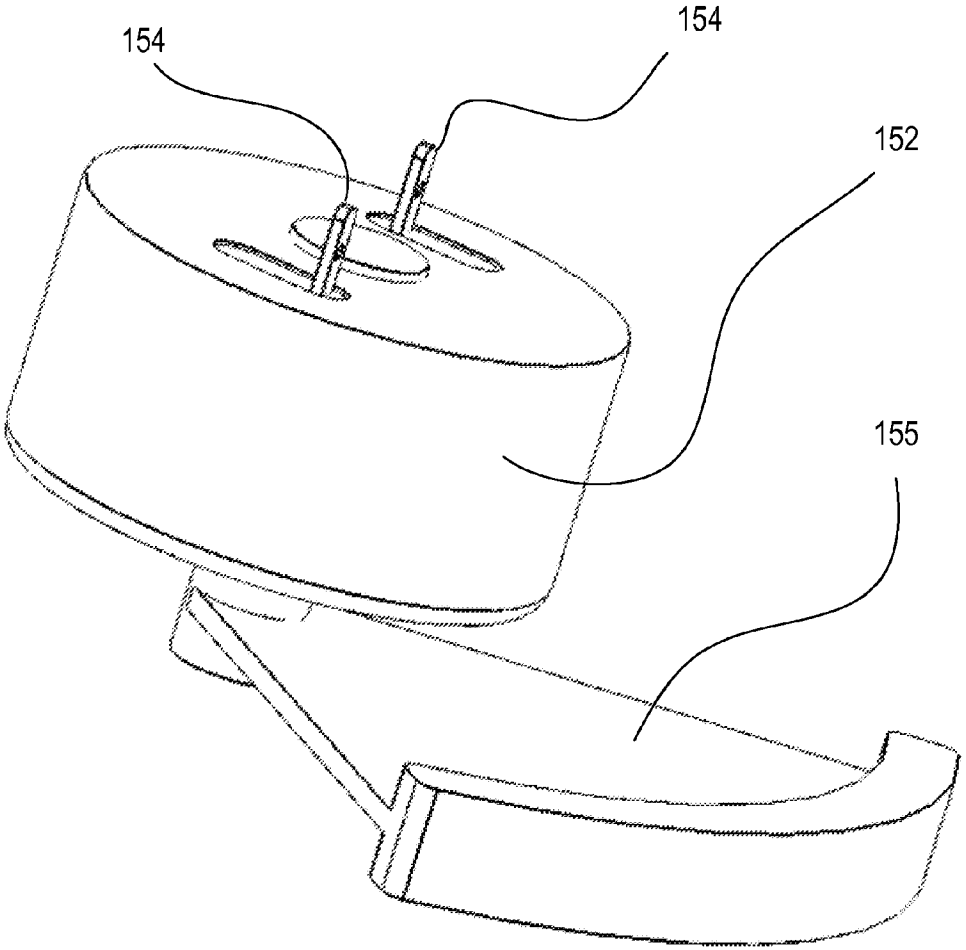
FIG. 20B is a perspective view of the pancake motor of FIG. 20A coupled to a counterweight.

The motor assembly 146 is disposed within the top housing 142 and includes a pancake motor 152. The pancake motor 152 is a conventional motor well known in the art, for example, a Mabuchi RF-300EA-8Z485, which is manufactured by Mabuchi Motor Co., Ltd., headquartered in Matsudo City of Chiba, Japan. The pancake motor 152 includes a rotating shaft 153 and two electrical connectors 154. The rotating shaft 153 is coupled to a counterweight 155, as can be seen in FIG. 20. Preferably, the counterweight 155 is an eccentric steel counterweight 155 weighing around three ounces, with the majority of the weight concentrated along a circumferential edge of the counterweight 155. The counterweight 155 preferably has holes in the portion between the circumferential edge and the rotating shaft 153. The counterweight 155 is coupled to the rotating shaft 153 such that when the rotating shaft 153 rotates, the counterweight 155 rotates with it. When the pancake motor is activated, the rotation of the counterweight 155 causes the alarm clock device 110 to shimmy, wobble, and/or shake.

It will be appreciated that when the alarm clock device 110 is oriented in certain configurations, e.g. when the plane the counterweight 155 rotates through is generally perpendicular to the Earth's surface, the motor 152 may sometimes have difficulty overcoming the force of gravity acting on the counterweight 155 to start up. For example, activating the pancake motor 152 when a battery or batteries powering the motor are low on power may not produce enough torque to pull the counterweight 155 over. In preferred implementations, a motor pulse occurs half a second before the motor 152 is started. This causes the counterweight 155 to swing forward some amount, and then fall backward, and thereby gain enough momentum to start the cycle of vibration as the motor 152 accelerates the counterweight 155 into full operation.

Figure 21:
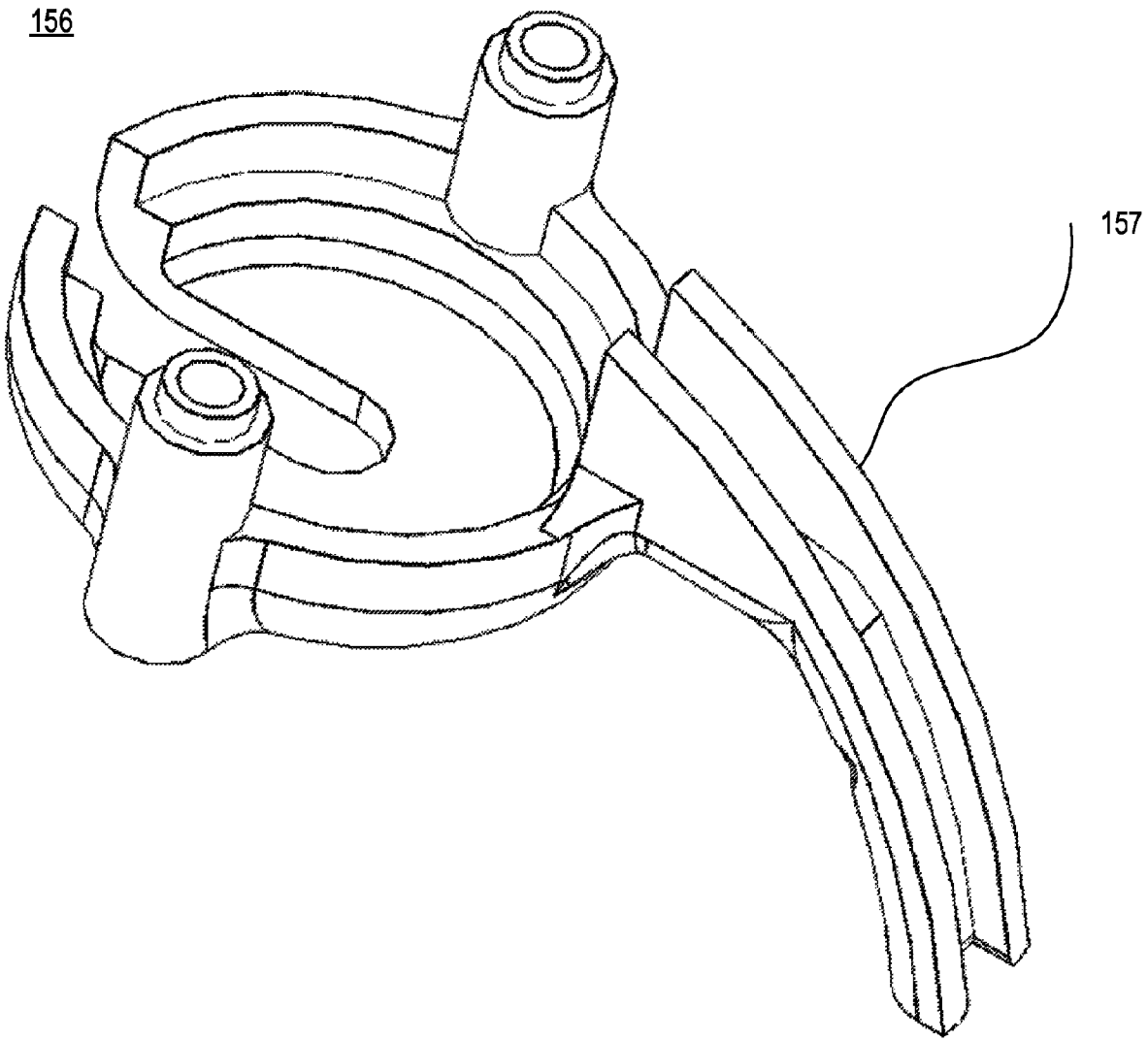
FIG. 21 is a perspective view of a motor mount.
Figure 22:
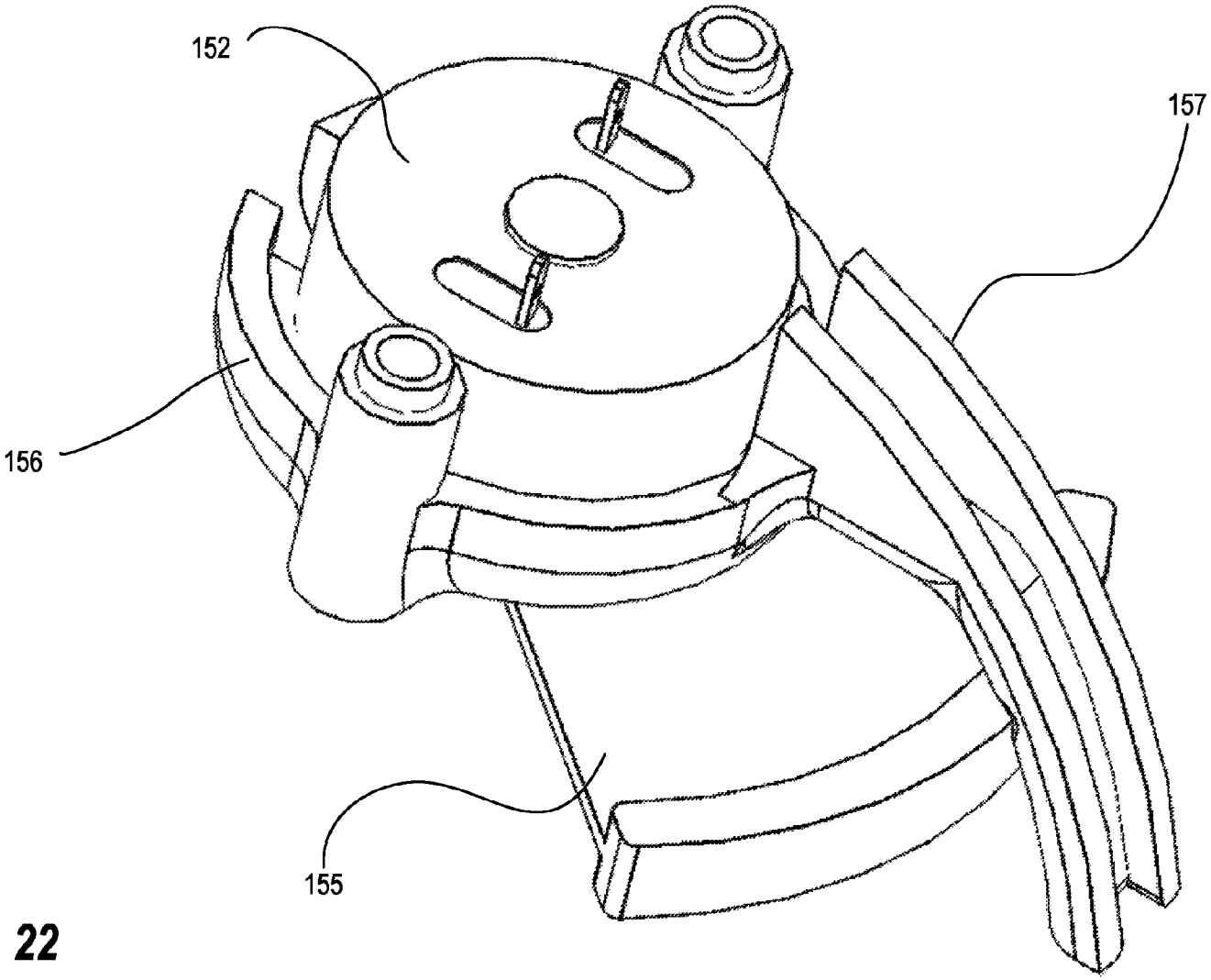
FIG. 22 is a perspective view of the motor mount of FIG. 21 with the pancake motor of FIG. 20A received therein.

The pancake motor 152 is received and retained within a motor mount 156, which motor mount 156 is illustrated by itself in FIG. 21, and together with the pancake motor 152 in FIG. 22. The motor mount 156 is configured to receive and retain the pancake motor 152, be secured to the top housing 142, and yet still allow the rotating shaft 153 to pass through it. Further, the motor mount 156 includes a wire guide 157. Power is delivered from conventional batteries, described in more detail hereinbelow, to the electrical connectors 154 of the pancake motor 152 by a wire (not shown). If the wire were to be loosely disposed without any guide, it could become entangled with the counterweight 155 when the pancake motor 152 is activated. To avoid this result, the wire may be disposed along the wire guide 157, which functions to prevent the wire from becoming entangled with the rotating counterweight 155.

Figure 23:
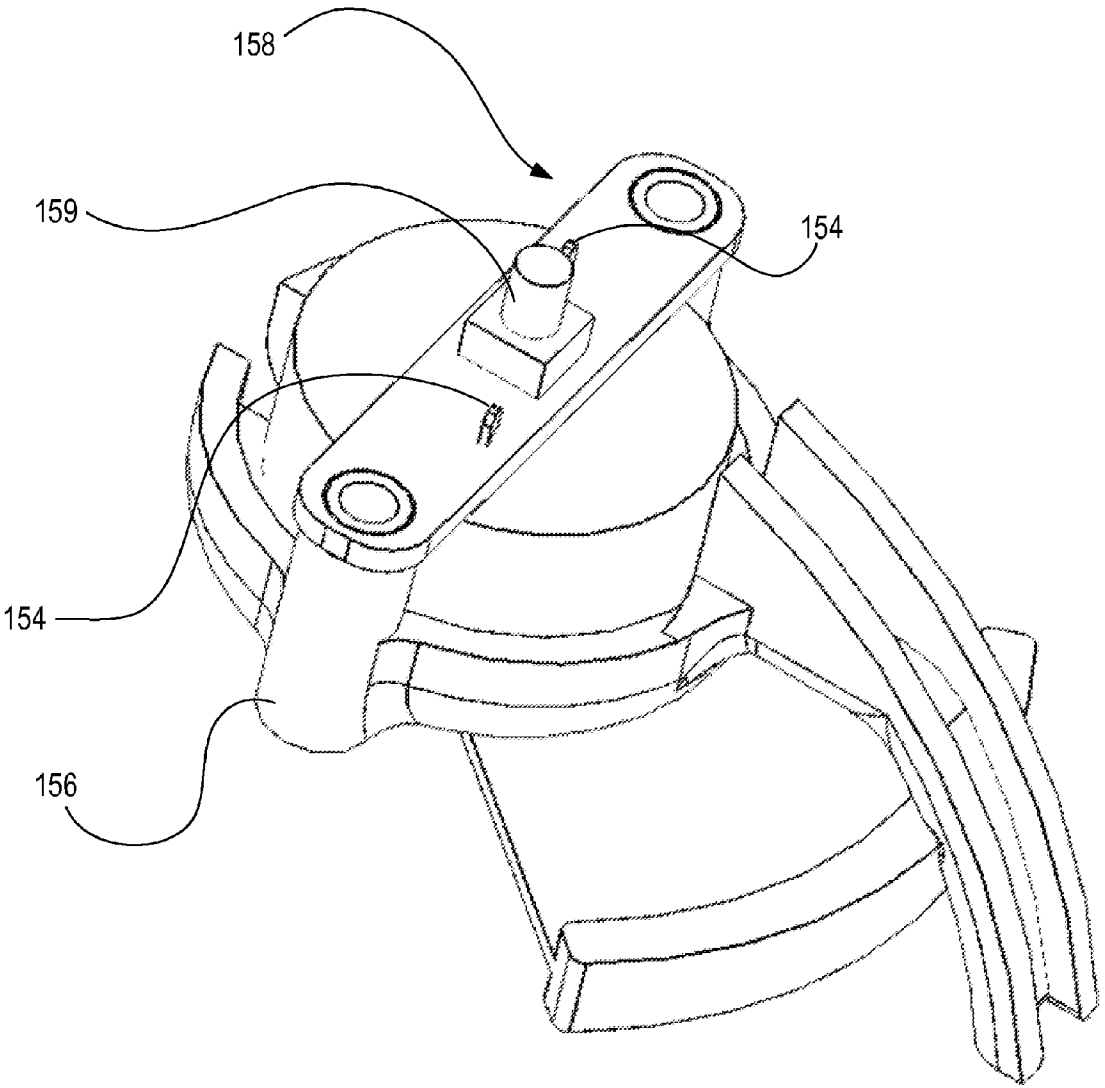
FIG. 23 is a perspective view of a snooze assembly illustrated together with the pancake motor of FIG. 20A, the motor mount of FIG. 21, and the counterweight of FIG. 20B.

Coupled to the motor mount 156 is a snooze assembly 158. The snooze assembly 158 includes a snooze tactile button 159. The snooze tactile button 159 is electronically coupled to the alarm clock component 130 by a wire (not shown). This wire may be the same wire as previously mentioned and/or may be bundled together with the previously mentioned wire as one wire bundle. In at least some preferred embodiments, the two electrical connectors 154 of the pancake motor 152 pass through the snooze assembly 158, as can be seen in FIG. 23. Preferably, engaging the snooze tactile button 159 delays the alarm for a predetermined period of time, as previously described with reference to button 22*e*.

Figure 24:
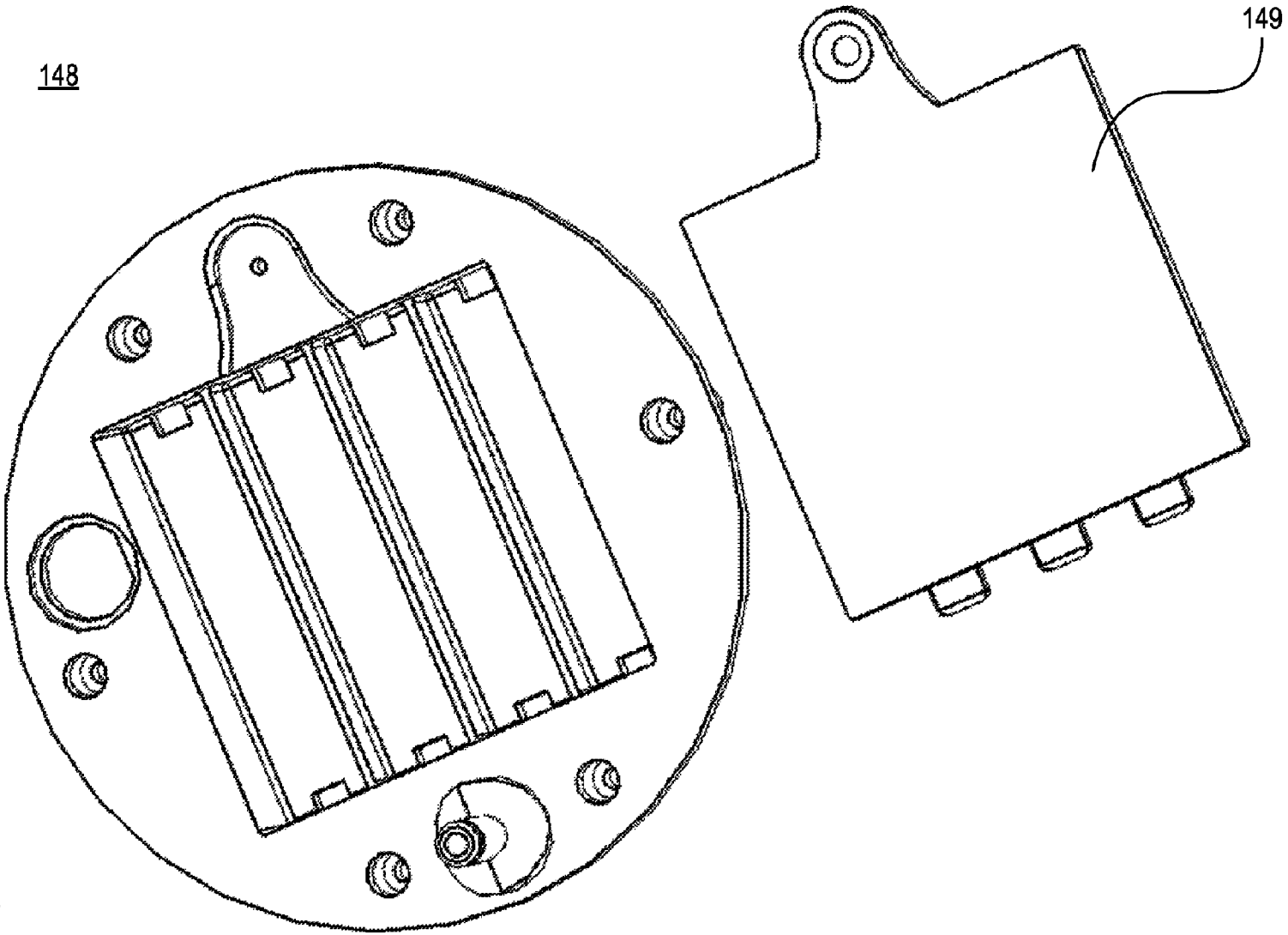
FIG. 24 is a perspective view of a top faceplate of the alarm clock device of FIG. 9.
Figure 25:
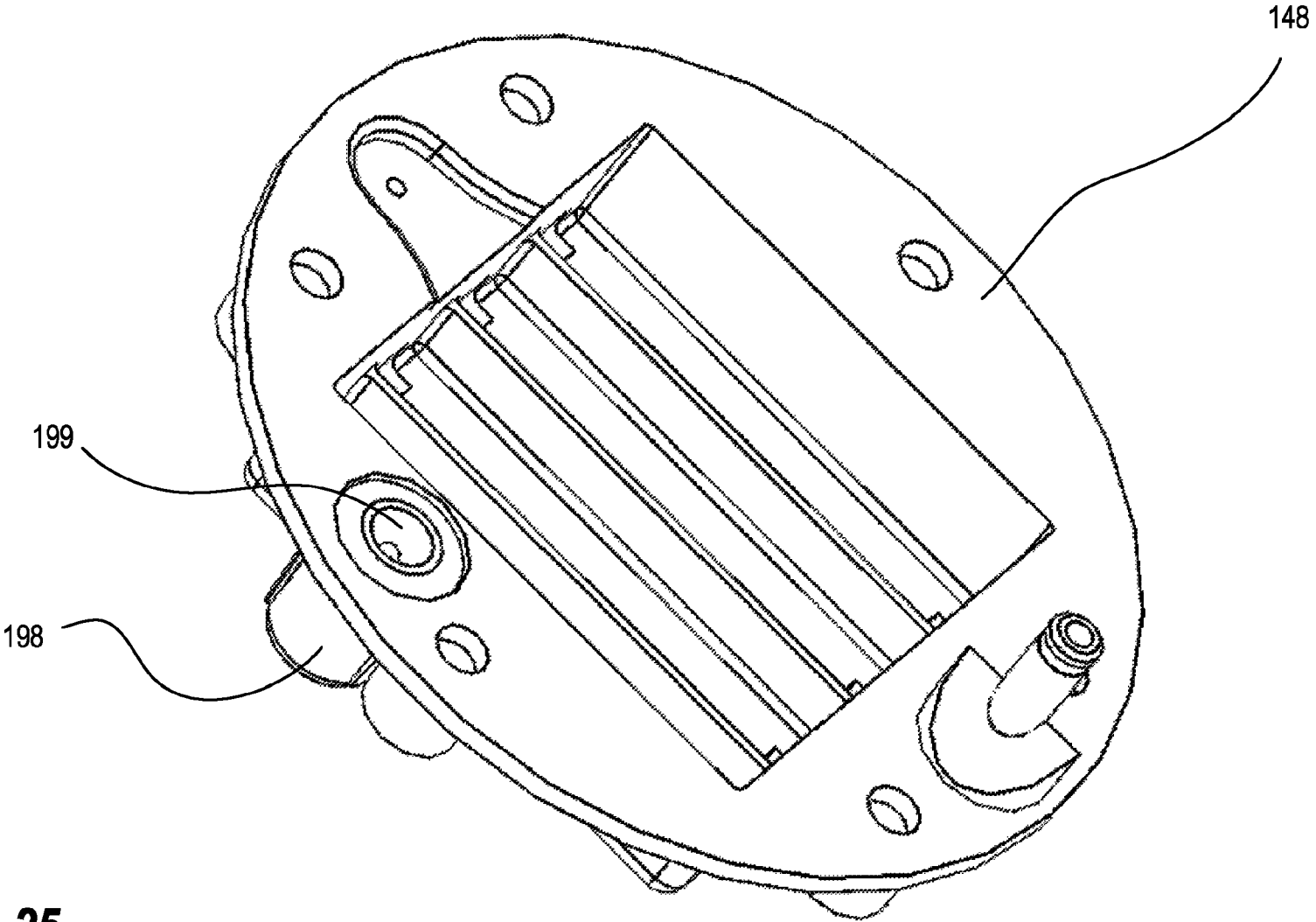
FIG. 25 is a perspective view of a charging apparatus and the top faceplate of FIG. 24.

FIG. 24 is a perspective view of the top faceplate 148 of the alarm clock device 110 of FIG. 9. The top faceplate 148 includes a removable battery door 149. A user may remove the battery door 149 to reveal a plurality of battery receptacles, as is well known in the art. The battery receptacles may be sized to receive AA or AAA batteries. In at least some alternative embodiments, other battery types may be utilized. It is also within the scope of the present invention that the batteries may be rechargeable batteries. FIG. 25 illustrates a charging apparatus 189 having a female charging port 199 adapted to receive a male charging plug for charging of rechargeable batteries received within the battery receptacles.

Figure 26:
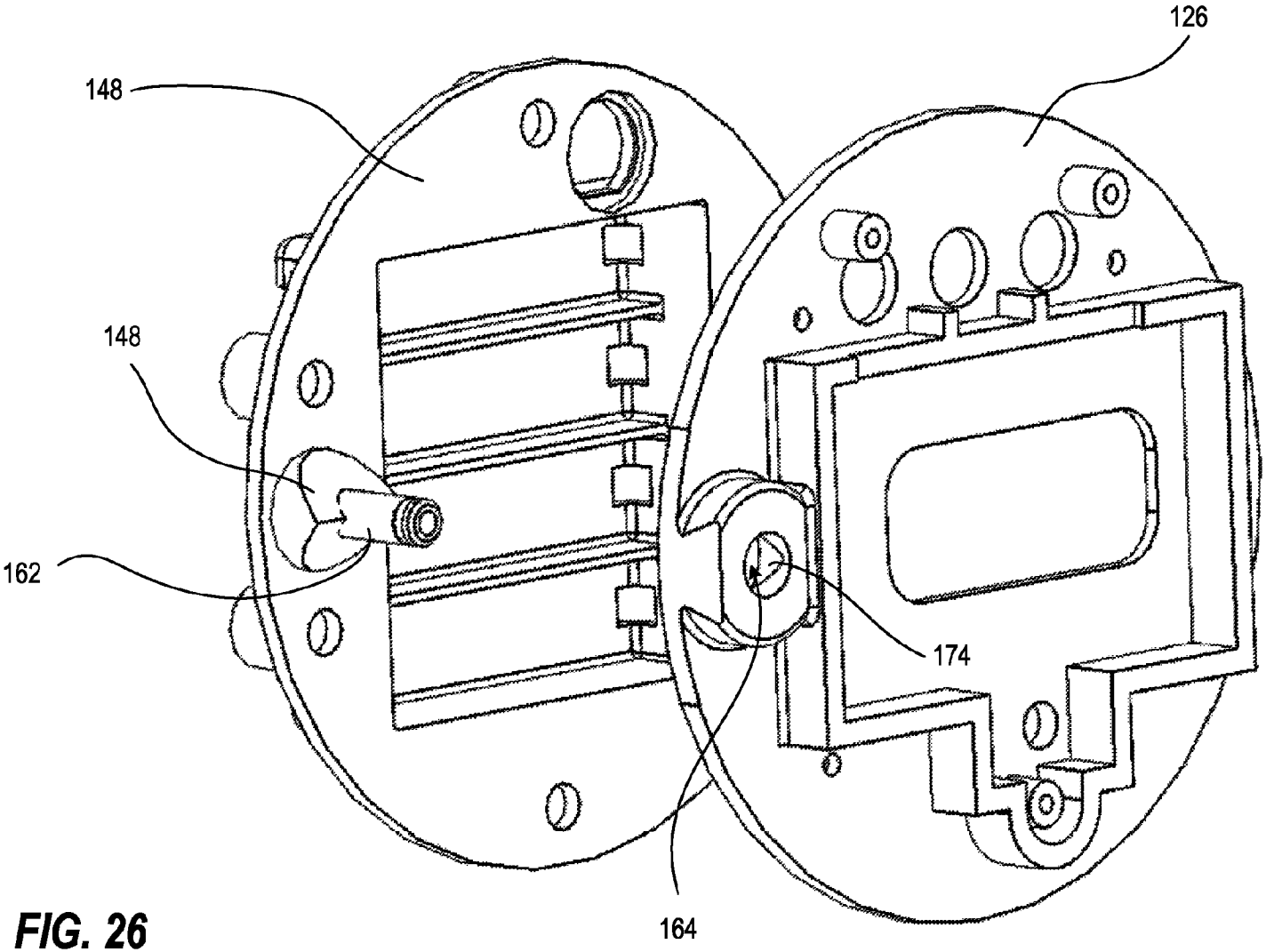
FIG. 26 is a perspective view of the top faceplate of FIG. 24 and the bottom faceplate of FIG. 15A illustrating a swivel member and an opening.
Figure 27:
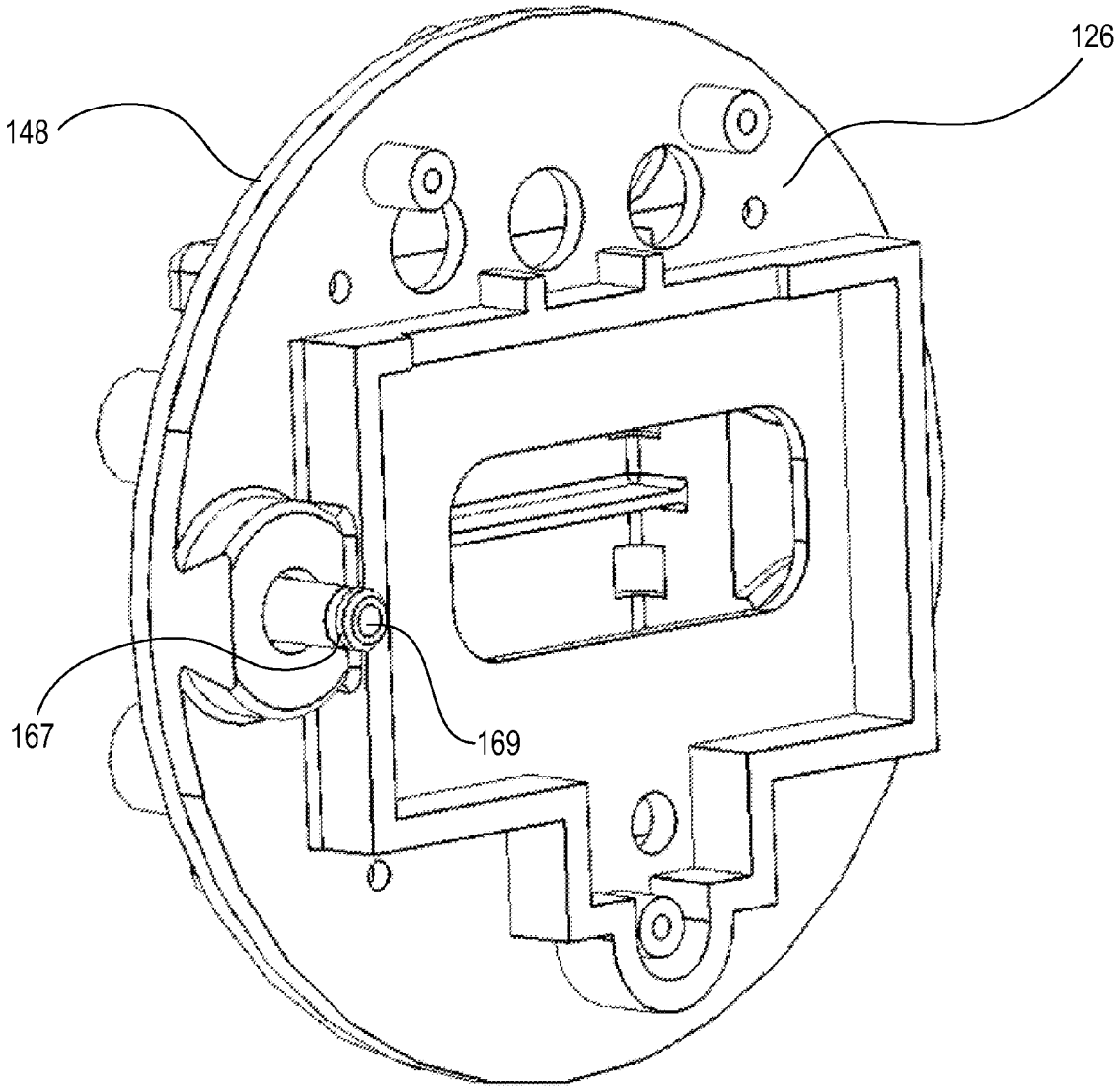
FIG. 27 is a perspective view of the faceplates of FIG. 26 illustrating how the swivel member passes through the opening.

As can be seen in FIG. 26, the top faceplate 148 further includes a swivel member 162, and the bottom faceplate 126 includes an opening 164 for receipt therethrough of the swivel member 162. FIG. 27 illustrates how the swivel member 162 is received through the opening 164.

Figure 28:
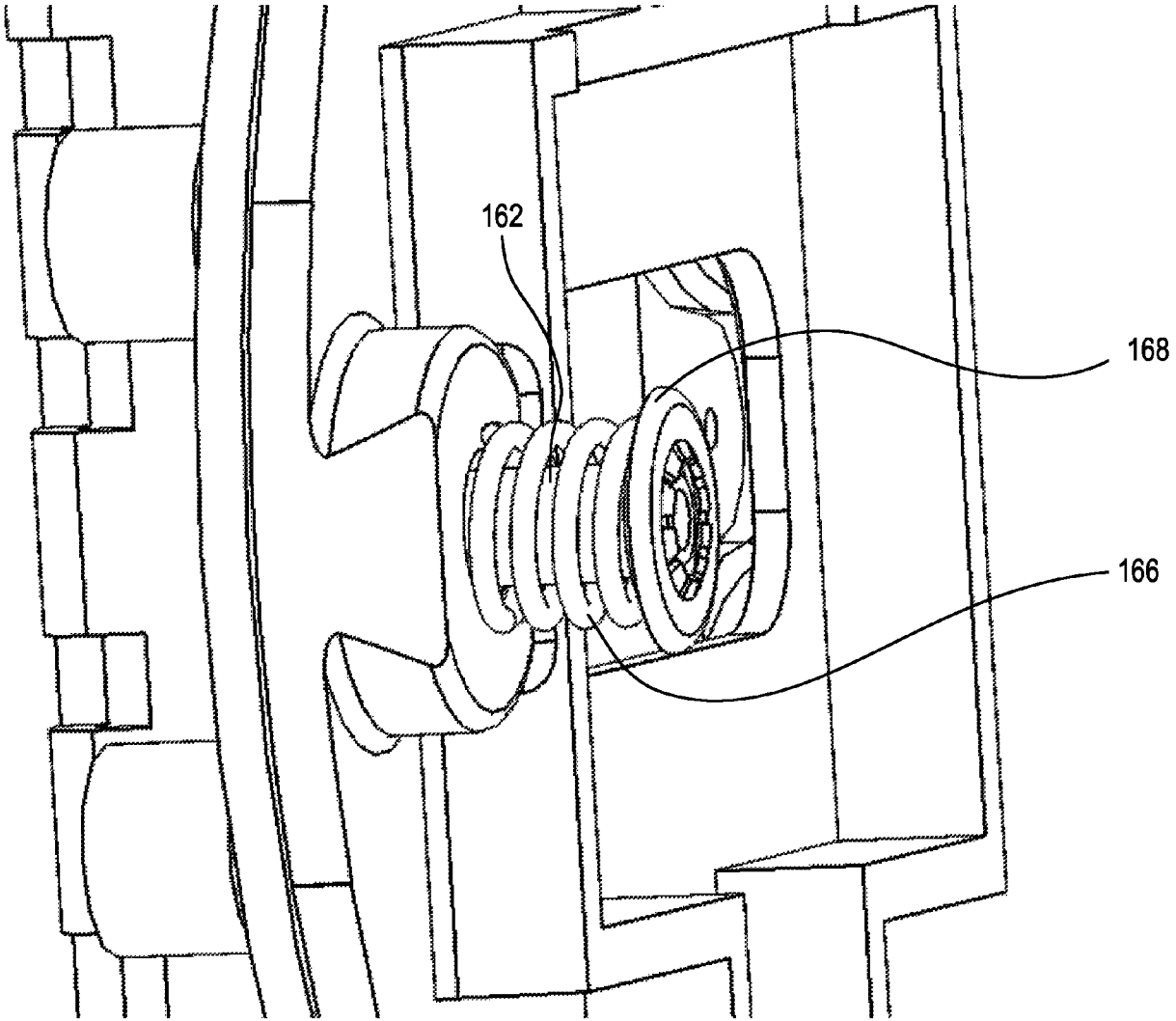
FIG. 28 is a fragmented perspective view of the faceplates of FIG. 26 illustrating how a tension member and washer can be secured to the swivel member thereby securing the faceplates together.

A tension member 166 encircles the swivel member 162 on the far side of the opening 164, as can be seen in FIG. 28. A washer 168 is slotted into a groove 167 proximate a distal end 169 of the swivel member 162. The washer 168 secures the tension member 166 to said swivel member 162 and secures the top faceplate 148 to the bottom faceplate 126, thereby securing the top assembly half 112 to the bottom assembly half 114 at pivot point. Along the outer edge of the opening 164 is a female curved beveled portion 174 that is configured to mate with a male curved beveled portion 172 protruding around the base of the swivel member 162. The curved beveled portions 172,174 are configured such that when the assembly halves 112,114 are swiveled relative to one another, the curved beveled portions 172,174 will only come to rest and properly mate at two positions, corresponding to the open and closed configurations discussed in greater detail above. It will be appreciated that the tension member 166 in combination with the curved beveled portions 172,174 biases the alarm clock device 110 towards the closer of the two configurations when the alarm clock device 110 is in any other position.

Figure 29:
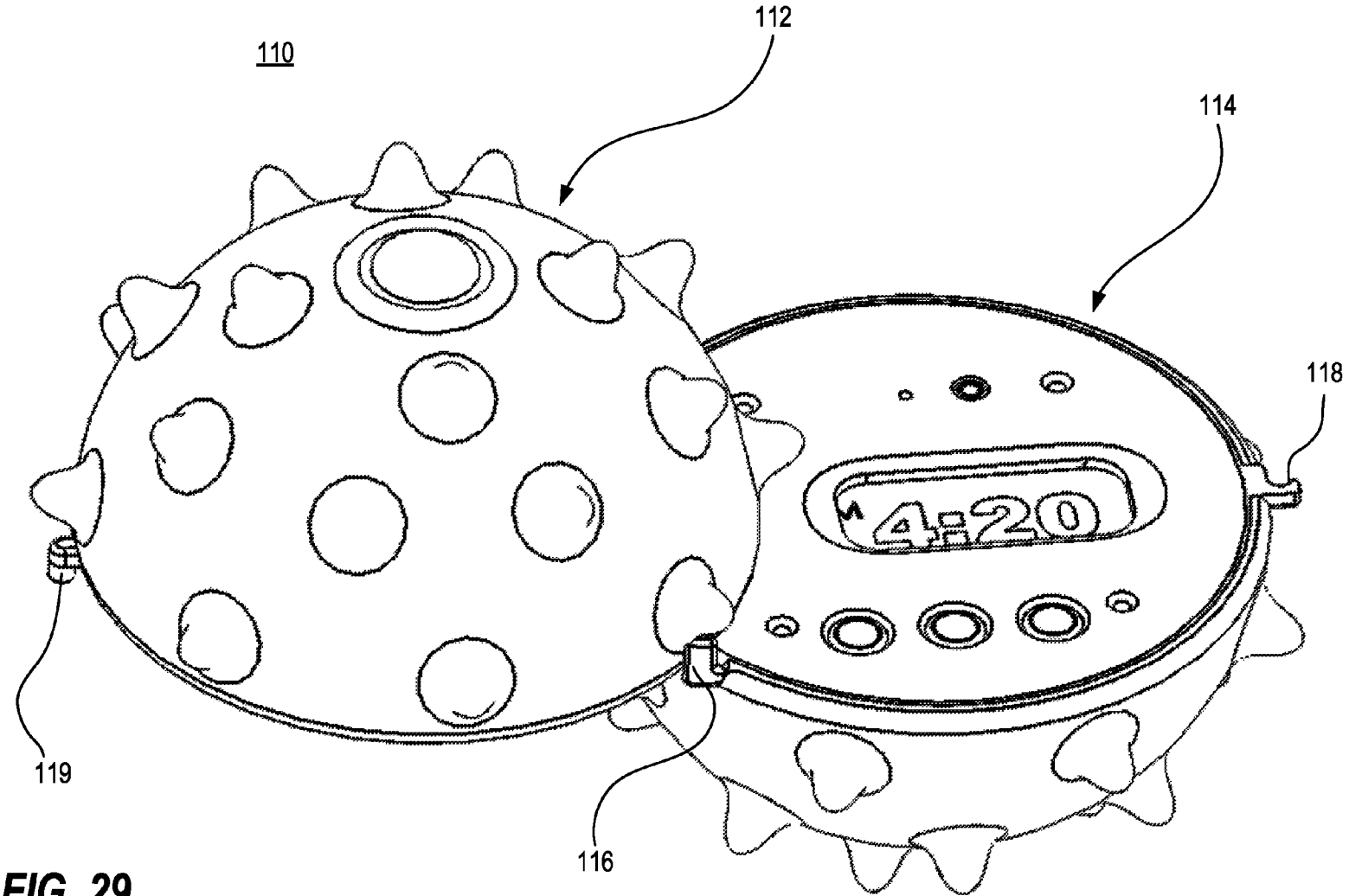
FIG. 29 is a perspective view of the alarm clock device of FIG. 9 illustrating stops utilized to hinder complete rotational freedom.

The swivel member 162 may be hollow. One or more wires (not shown) pass through the swivel member 162 and electrically and/or electronically connect components disposed within each of the two assembly halves 112,114. It will be appreciated that if the two assembly halves 112,114 were swiveled relative to each other a great number of revolutions, wires passing through the swivel member 162 could become tangled. To prevent the assembly halves 112,114 from swiveling relative to each other in a complete revolution, one or both of the assembly halves 112,114 includes one or more stops, as can be seen in FIG. 29. Preferably, the bottom assembly half 114 has a single pivot stop 116. In at least some embodiments, however, the bottom assembly half 114 has a pivot stop 116, together with a mating pivot stop 118, and the top assembly half has a mating pivot stop 119, which is positioned to abut the mating pivot stop 118 when the alarm clock device 110 is in the closed configuration.

As depicted in the drawings, many of the components of the alarm clock device 110 are preferably connected together with screws, but it is within the scope of the present invention to use other forms of connectors in place of or in addition to the use of screws.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. An alarm device comprising:

a) a first portion housing an alarm component for producing an audible sound upon actuation in response to an alarm event; and b) a second portion housing a vibration-inducing component for producing shaking movement in the device upon actuation in response to an alarm event;

c) wherein the first and second portions are pivotably engaged with one another to permit swiveling movement of one of either the first or second portion relative to the other portion between:

1) a first position, wherein opposing surfaces of each of the first and second portions are substantially fully aligned with one another; and 2) a second position, wherein opposing surfaces of each of the first and second portions are substantially exposed;

Wherein in the first position the first and second portions are configured such that the shaking movement causes the alarm device to substantially move around the alarm device's surroundings.

2. The alarm device of claim 1, wherein the alarm component and the vibration-inducing component are actuatable in response to the same alarm event.

3. The alarm device of claim 1, wherein the alarm event is a selected time of day.

4. The alarm device of claim 1, further comprising a plurality of protrusions arranged exteriorly on the first and second portions for cushioning the device during shaking movement.

5. The alarm device of claim 1, further comprising a power source for providing electrical energy to the alarm component and the vibration-inducing component.

6. The alarm device of claim 5, wherein the power source is a battery power source.

7. The alarm device of claim 6, wherein the battery power source is rechargeable.

8. The alarm device of claim 1, wherein the alarm component comprises a mechanical alarm clock.

9. The alarm device of claim 1, wherein the alarm component comprises an electronic alarm clock.

10. The alarm device of claim 1, wherein the vibration-inducing component comprises an eccentrically mounted weight, the rotation of which is powered by a motor housed within the second portion.

11. The alarm device of claim 1, wherein the first and second portions jointly define a generally spherical shape when oriented in the first position.

12. The alarm device of claim 1, wherein a time display housed in the first portion is revealed when the first and second portions are oriented in the second position.

13. An alarm device comprising:

a) a first portion housing an alarm component for producing an audible sound upon actuation in response to an alarm event;

b) a second portion housing a vibration-inducing component for producing shaking movement in the device upon actuation in response to an alarm event; and c) a plurality of protrusions arranged exteriorly on the first and second portions for cushioning the device during shaking movement;

d) wherein the first and second portions are pivotably engaged with one another to permit swiveling movement of one of either the first or second portion relative to the other portion between:

1) a first position, wherein opposing surfaces of each of the first and second portions are substantially fully aligned with one another; and 2) a second position, wherein opposing surfaces of each of the first and second portions are substantially exposed; and e) wherein a time display housed in the first portion is revealed when the first and second portions are oriented in the second position;

Wherein in the first position the first and second portions are configured such that the shaking movement causes the alarm device to substantially move around the alarm device's surroundings.

14. A method of using an alarm device to wake a person comprising the steps of:

Providing an alarm device, wherein the alarm device comprises a first portion housing an alarm clock component and a second portion housing a vibration-inducing component for producing shaking movement in the device, wherein the first and second portions are pivotably engaged with one another to permit swiveling movement of one of either the first or second portion relative to the other portion between: 1) a first position, wherein opposing surfaces of each of the first and second portions are substantially fully aligned with one another; and 2) a second position, wherein opposing surfaces of each of the first and second portions are substantially exposed; and wherein a time display housed in the first portion is revealed when the first and second portions are oriented in the second position; Wherein in the first position the first and second portions are configured such that the shaking movement causes the alarm device to substantially move around the alarm device's surroundings;

Setting the alarm device to be actuated at a preset alarm time;

Orienting the alarm device in the first position;

Waiting until after the preset alarm time;

Orienting the alarm device in the second position; and

Deactivating the alarm.

15. The method of claim 14, wherein the alarm device further comprises a plurality of protrusions arranged exteriorly on the first and second portions for cushioning the device during shaking movement.

16. The method of claim 14, wherein the alarm device further comprises a power source for providing electrical energy to the alarm clock component and the vibration-inducing component.

17. The method of claim 14, wherein the alarm clock component comprises a mechanical alarm clock.

18. The method of claim 14, wherein the alarm component comprises an electronic alarm clock.

19. The method of claim 14, wherein the vibration-inducing component comprises an eccentrically mounted weight, the rotation of which is powered by a motor housed within the second portion.

20. The method of claim 14, further comprising the step of deactivating the alarm device to cease production of the audible sound and the shaking movement.

* * * * *